US008179328B2

(12) United States Patent
Brown

(10) Patent No.: US 8,179,328 B2
(45) Date of Patent: May 15, 2012

(54) DIRECTION FINDING ANTENNA

(75) Inventor: Glenn F. Brown, Fairfax, VA (US)

(73) Assignee: Astron Wireless Technologies, Inc., Sterling, VA (US)

( * ) Notice: Subject to any disclaimer, the term of this patent is extended or adjusted under 35 U.S.C. 154(b) by 598 days.

(21) Appl. No.: 12/355,431

(22) Filed: Jan. 16, 2009

(65) Prior Publication Data

US 2009/0237318 A1 Sep. 24, 2009

Related U.S. Application Data

(60) Provisional application No. 61/037,941, filed on Mar. 19, 2008.

(51) Int. Cl.
*H01Q 21/00* (2006.01)
*H01Q 13/00* (2006.01)

(52) U.S. Cl. ..... 343/725; 343/773; 343/810; 343/816; 343/820; 343/891

(58) Field of Classification Search ..... 343/725, 343/773, 810, 816, 820, 890, 891
See application file for complete search history.

(56) References Cited

U.S. PATENT DOCUMENTS

| | | | |
|---|---|---|---|
| 4,584,582 | A | 4/1986 | Munger |
| 5,506,592 | A | 4/1996 | MacDonald et al. |
| 5,644,321 | A | 7/1997 | Benham |
| 5,714,964 | A | 2/1998 | Jackson |
| 5,767,814 | A | 6/1998 | Conroy et al. |
| 5,880,695 | A | 3/1999 | Brown et al. |
| 6,249,261 | B1 | 6/2001 | Solberg, Jr. et al. |
| 6,295,035 | B1 | 9/2001 | Holzheimer |
| 6,346,920 | B2 | 2/2002 | Sharp et al. |
| 6,515,632 | B1 | 2/2003 | McLean |
| 6,570,543 | B1 | 5/2003 | Solberg, Jr. et al. |

OTHER PUBLICATIONS

International Search Report and Written Opinion in PCT/US2009/037457, dated May 18, 2009.

*Primary Examiner* — Hoang V Nguyen
(74) *Attorney, Agent, or Firm* — Womble Carlyle

(57) ABSTRACT

Systems and methods provide a HESA ("High Efficiency Sensitivity Accuracy") direction-finding ("DF") antenna system that operates over a range from 2 MHz to 18 GHz. The system may include components such as a dipole array, a monopole array, and an edge-radiating antenna, each component being responsive to a specific frequency range. The system may further include biconical flares that optimally terminate a freespace wave in a small aperture.

31 Claims, 32 Drawing Sheets

DIRECTION FINDING ANTENNA

RELATED APPLICATION

This application claims priority to provision application No. 61/037,941 filed Mar. 19, 2008.

FIELD OF THE INVENTION

One embodiment is directed to antennas, and more particularly directed to direction finding antennas.

BACKGROUND INFORMATION

Radio direction finding is the process of electronically determining the direction of arrival of a radio signal transmission. The techniques for obtaining cross bearings of an emitter and using triangulation to estimate target positions are well-known. The ability to ascertain the geographical location of an emitting transmitter offers important capabilities for many modem communications applications, such as land, air, and sea rescue, duress alarm and location, law enforcement, and military intelligence. There are numerous direction-finding antennas and systems in the prior art.

It is advantageous to design direction finding antennas that can fit in small packages, especially where those direction finding antennas are intended to be portable and used in the field. However, it is difficult to build direction finding antennas for small packages without sacrificing bandwidth, frequency response, and signal detection quality.

SUMMARY OF THE INVENTION

Systems and methods in accordance with an embodiment are directed to a HESA ("High Efficiency Sensitivity Accuracy") direction-finding ("DF") antenna system. One embodiment is a direction-finding antenna with electronics for receiving radio signals in a frequency range of about 2 megaHertz to about 18 gigaHertz. The direction-finding antenna may include several components for different frequency ranges. In one embodiment, one component is an edge-radiating antenna comprising a first plate and a second plate disposed parallel to each other and radiating into open space, a concentric cylinder connecting the first plate to the second plate, eight feed points disposed equally around the outside of the concentric cylinder with eight feed lines extending from the first plate to the second plate, and a shunt resistor across each feed gap. The eight feed lines are electrically coupled to a beam forming matrix that detects the direction of a beam.

In another embodiment, a component is a monopole array comprising eight monopole elements connected to a first center mast. The monopole array is disposed inside the concentric cylinder and modified with resistors such that no resonance occurs. The eight monopole elements are electrically coupled to a beam forming matrix that finds a direction of a beam.

In yet another embodiment, a component is a dipole array comprising eight dipole elements connected to a second center mast. Each of the eight dipole elements is resistively loaded to increase bandwidth, and the eight dipole elements are electrically coupled to a beam forming matrix that detects the direction of a beam. The second center mast may include a plurality of resistors disposed on the mast to prevent resonance.

In yet another embodiment, a component is a biconical horn that houses the edge-radiating antenna or dipole array.

The biconical horn comprises eight ribs connecting a top horn to a bottom horn. The eight ribs are electrically coupled to a high impedance resistor disposed at the center of the biconical horn. The top horn and bottom horn of the biconical horn may include a base having an aperture termination including resistors in shunt with each other.

In yet another embodiment, the beam forming matrix includes eight inputs, a sine pattern output, a cosine pattern output, and an omni directional pattern output. The eight inputs include inputs A, B, C, D, E, F, G and H, and the sine pattern equals (input C+input D)−(input G+input H), the cosine pattern equals (input A+input B)−(input E+input F), and the omni directional pattern is the sum of the eight inputs. The sine, cosine, and omni directional patterns are used to calculate a direction of arrival (period) versus "a beam."

DETAILED DESCRIPTION

Figure 1:
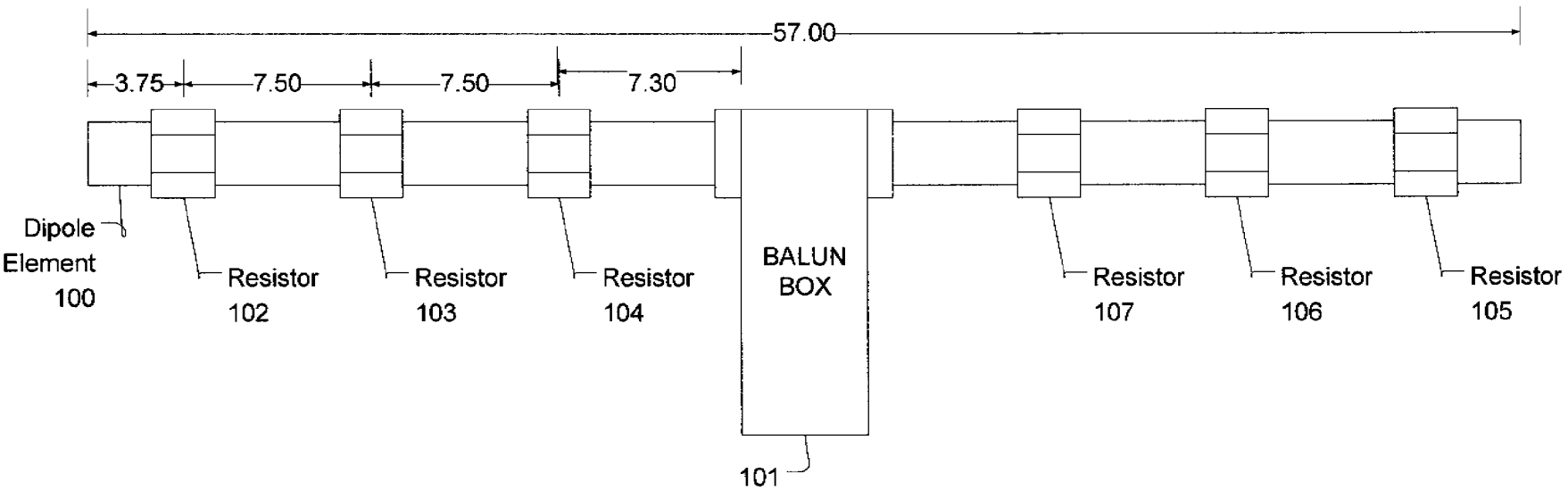
FIG. 1 illustrates the mechanical layout of one dipole element of a dipole array in accordance with an embodiment.

Systems and methods in accordance with an embodiment are directed to a HESA ("High Efficiency Sensitivity Accuracy") direction-finding ("DF") antenna system that operates over a range from 2 MHz to 18 GHz. The basic antenna comprises an upper plate and a lower plate connected by a short circuit element. The feed region is spaced out from the short circuit a specific distance that enables the highest frequency of operation to produce an omni-directional pattern when connected to a beam forming network with a uniform amplitude and uniform phase distribution. The distance between each of the feed elements is such that an omni-directional pattern is achieved. The antenna may be circular as may be the arrangement of the feeds. The antenna aperture may be directly at the feed region or may be extended beyond the feed region by a parallel plate region or biconical flare region.

The feeds are launched from the top or bottom of the feed region and impedance matched to the antenna driving point impedance by using one or more of the following techniques: series transmission lines, shunt transmission lines, resistors placed in series with feed elements, and resistors placed in shunt with feed elements. The combination of techniques results in a highly sensitive feed region with efficient transfer of fields from the feed region to transverse electric and magnetic ("TEM") mode coaxial cable that connects to a beam forming network.

Resistors may be placed on the feed elements to stabilize the element impedance in electrically small antennas. The resistors may also be placed in series on an element in strategic areas to minimize higher order modes from propagating for bandwidth extension. Typically, resistors in an array configuration have a net value impedance (free space) around 377 ohms. For example, an Altshuler antenna array may be an example where this value is important. Instead, one embodiment here finds that in order to achieve more gain and minimize losses, an appropriate resistor value is a net value of 200-300 ohms/impedance range. Here, a total value for a typical array of eight resistors would be in the 1600-2400 ohm range to net out 200-300 ohms (impedance), which achieves more gain. For a 32 resistor array, for example, a total of 6400-9600 ohm range will net out a resistor array impedance of 200-300 ohms. Unlike conventional systems, more gain is achieved with a lower net ohms/impedance value in the resistors.

An antenna system may include multiple types of antennas operating in different frequency ranges. In one embodiment, an antenna system includes some or all of a dipole array, a monopole array, an edge-radiating antenna, and a modified Vivaldi launch structure. The components are connected to a beam forming matrix for determining the direction of a signal.

Dipole Array

Typically, the usual elements for small antenna direction finding antenna elements are dipoles or loop elements that have limited bandwidths. In an embodiment, dipoles are modified by adding resistors near the ends of the elements to pull up the input impedance. This increases the bandwidth to approximately 3:1. To increase the bandwidth even further, a second resistive termination located one half of a wavelength away may be added, the wavelength being determined by the desired highest frequency of operation. This increases the bandwidth to 5:1. Each additional resistive termination will increase the bandwidth to 7:1, 9:1, and so on. For very short dipoles at extremely low frequencies, resistors may be placed across the feed point to stabilize the driving feed point impedance to a level where the radiation resistance of the antenna is raised to a level where impedance matching can occur. There may be a tradeoff in efficiency vs. impedance, however. Efficiency is lost at the high end of the frequency band, while impedance stabilization is achieved at the lowest frequencies for uniform power transfer.

FIG. 1 illustrates the mechanical layout of one dipole element of a dipole array in accordance with an embodiment. In this example, dipole element 100 is 57 cm long with a balun box 101 disposed at the middle of dipole element 100. A resistor 102 is disposed 3.75 cm from the end of dipole element 100, with a second resistor 103 disposed 7.5 cm from the center of resistor 102, and a third resistor 104 disposed 7.5 cm from the center of resistor 102. A mirror image is made on the other side of balun box 101 with resistors 105, 106, and 107, respectively. In one embodiment, the impedance of resistors 102-107 is 200-300 Ohms. This type of dipole element is then arrayed around a cylinder or mast using eight such elements.

Figure 2:
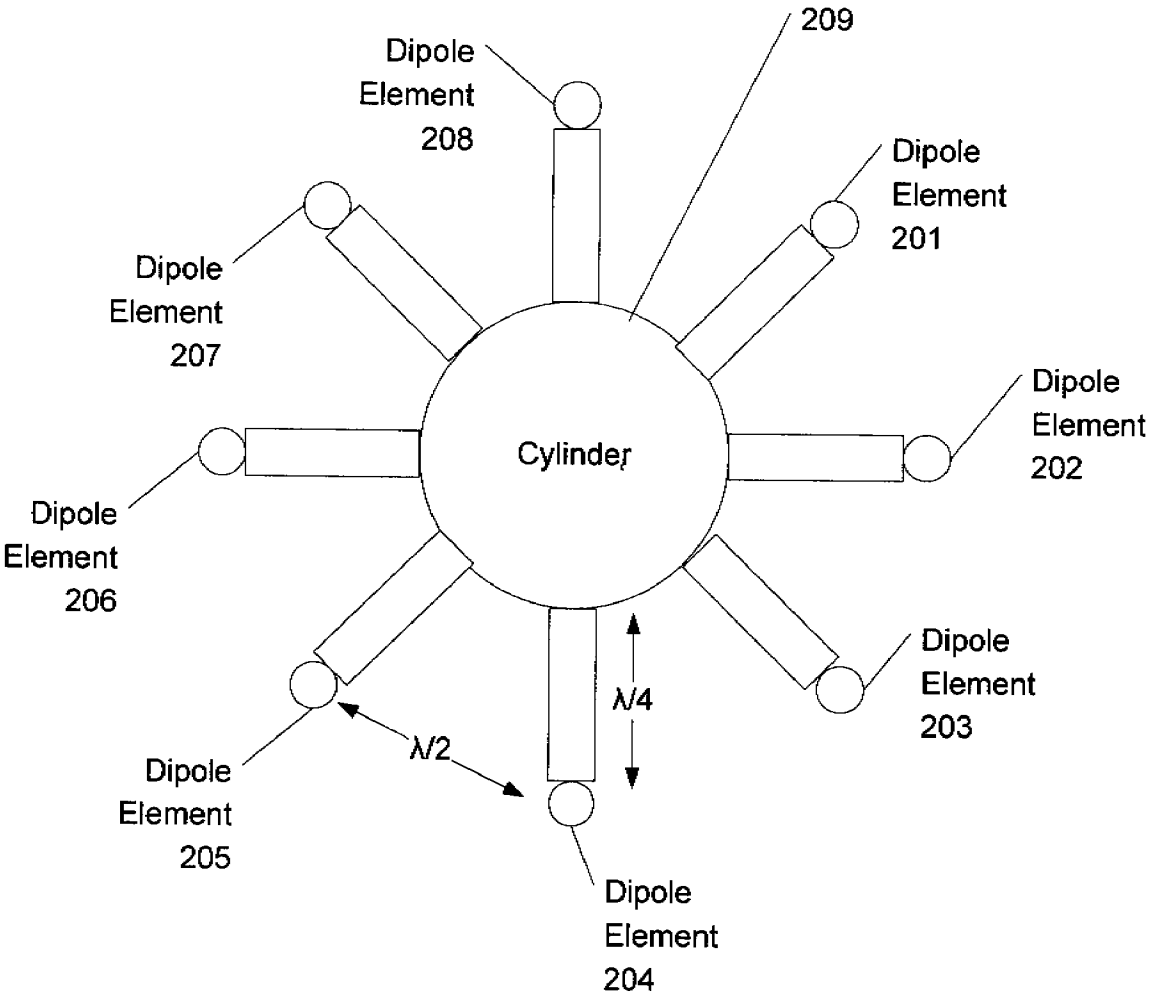
FIG. 2 illustrates a vertical cross section of a dipole array in accordance with an embodiment.
Figure 3:
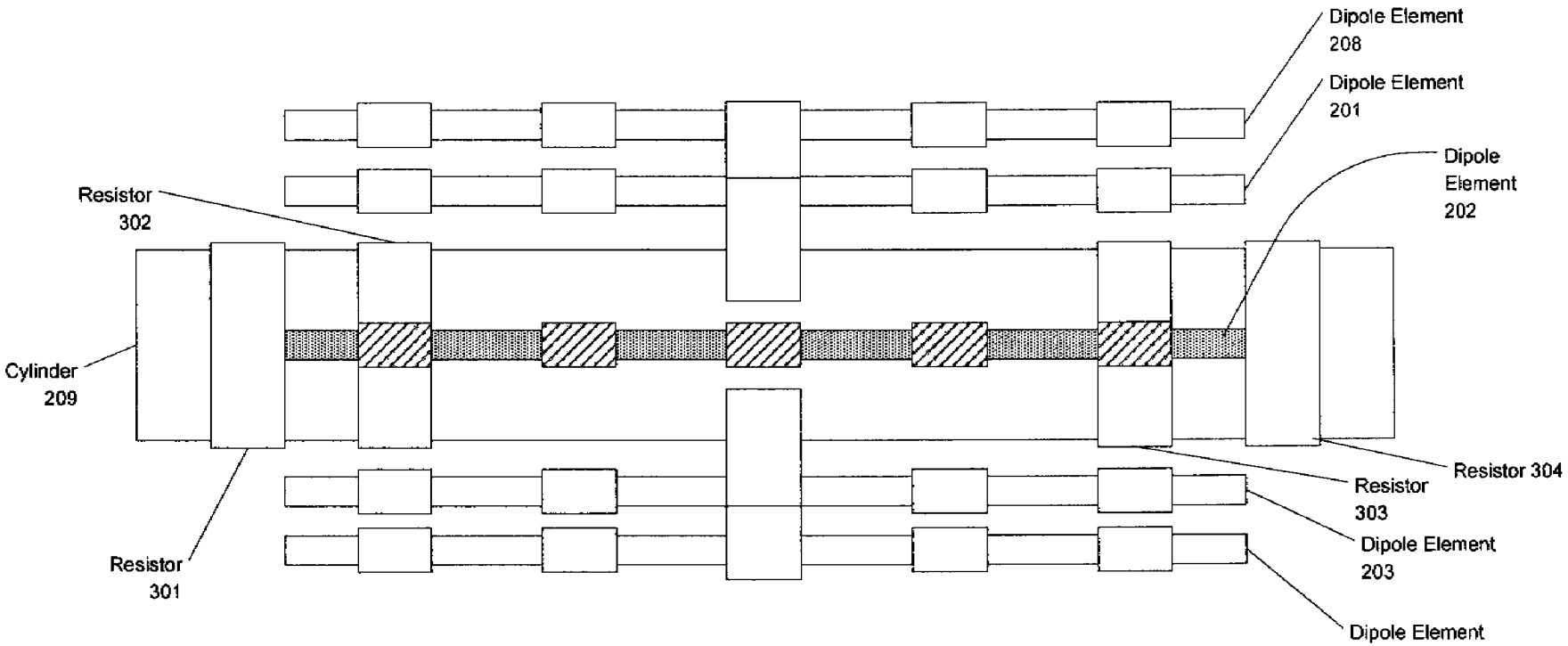
FIG. 3. illustrates a horizontal cross section of dipole array in accordance with an embodiment.

FIG. 2 illustrates an end view of a dipole array 200 in accordance with an embodiment. Dipole elements 201-208 correspond to a dipole element such as dipole element 100. In one embodiment, these dipole elements 201-208 are spaced approximately a ¼ wavelength at the highest frequency of operation away from cylinder 209, and about ½ wavelength apart on the circumference so that when connected to a beam forming matrix (discussed infra), the direction finding patterns of omni, sine and cosine are formed. FIG. 3. illustrates a horizontal view of dipole array 200 in accordance with an embodiment. In this view, dipole elements 208, 201, 202, 203, and 204 are shown, whereas dipole elements 205-207 are not visible from this angle. Dipole element 202 is shaded to differentiate it from cylinder 209. Cylinder 209 further includes resistors 301-304 decouple the dipole elements 201-208 to eliminate unwanted current resonances on the antenna body.

Edge-Radiating Antenna

Figure 4:
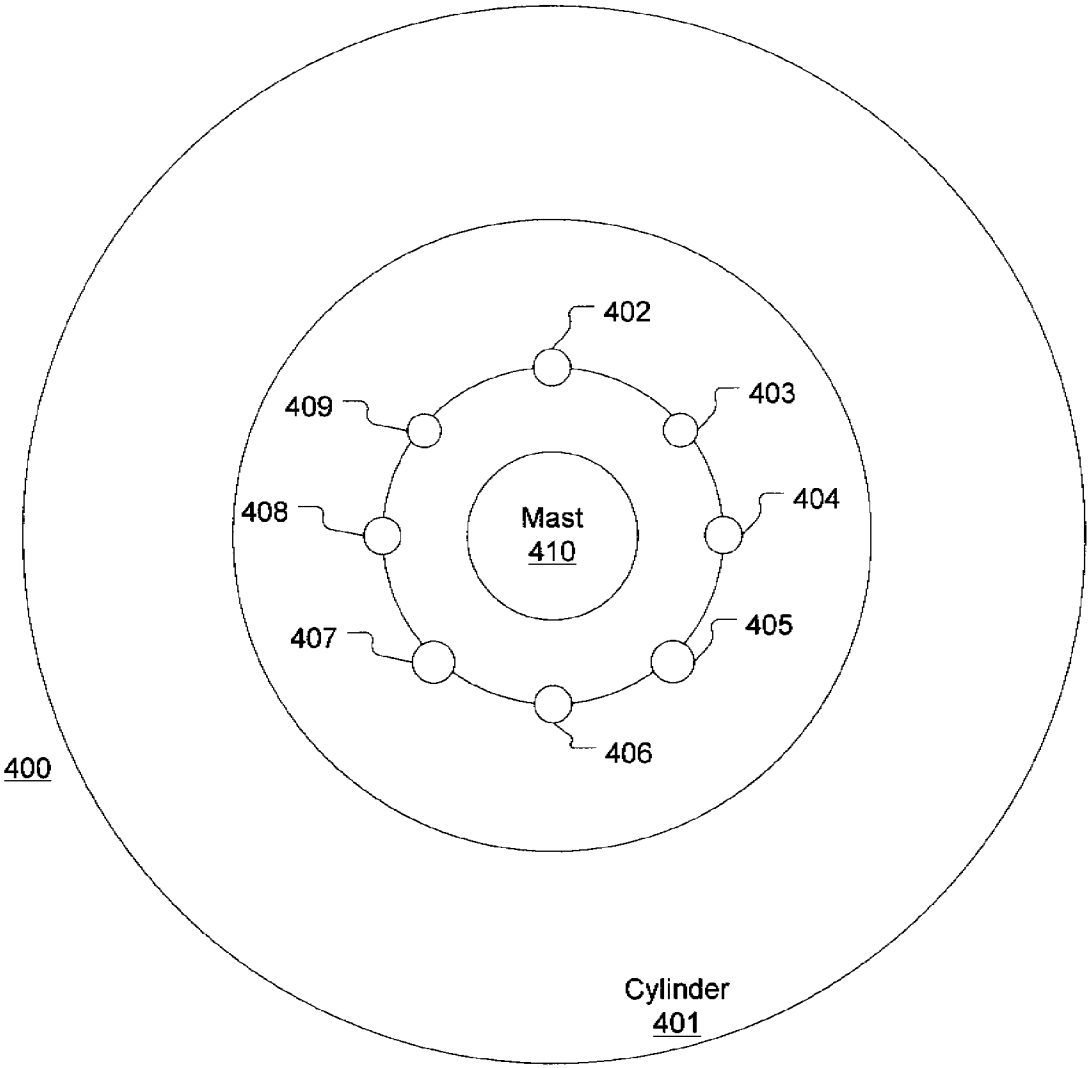
FIG. 4 illustrates a cross section of edge-radiating antenna in accordance with an embodiment.
Figure 5:
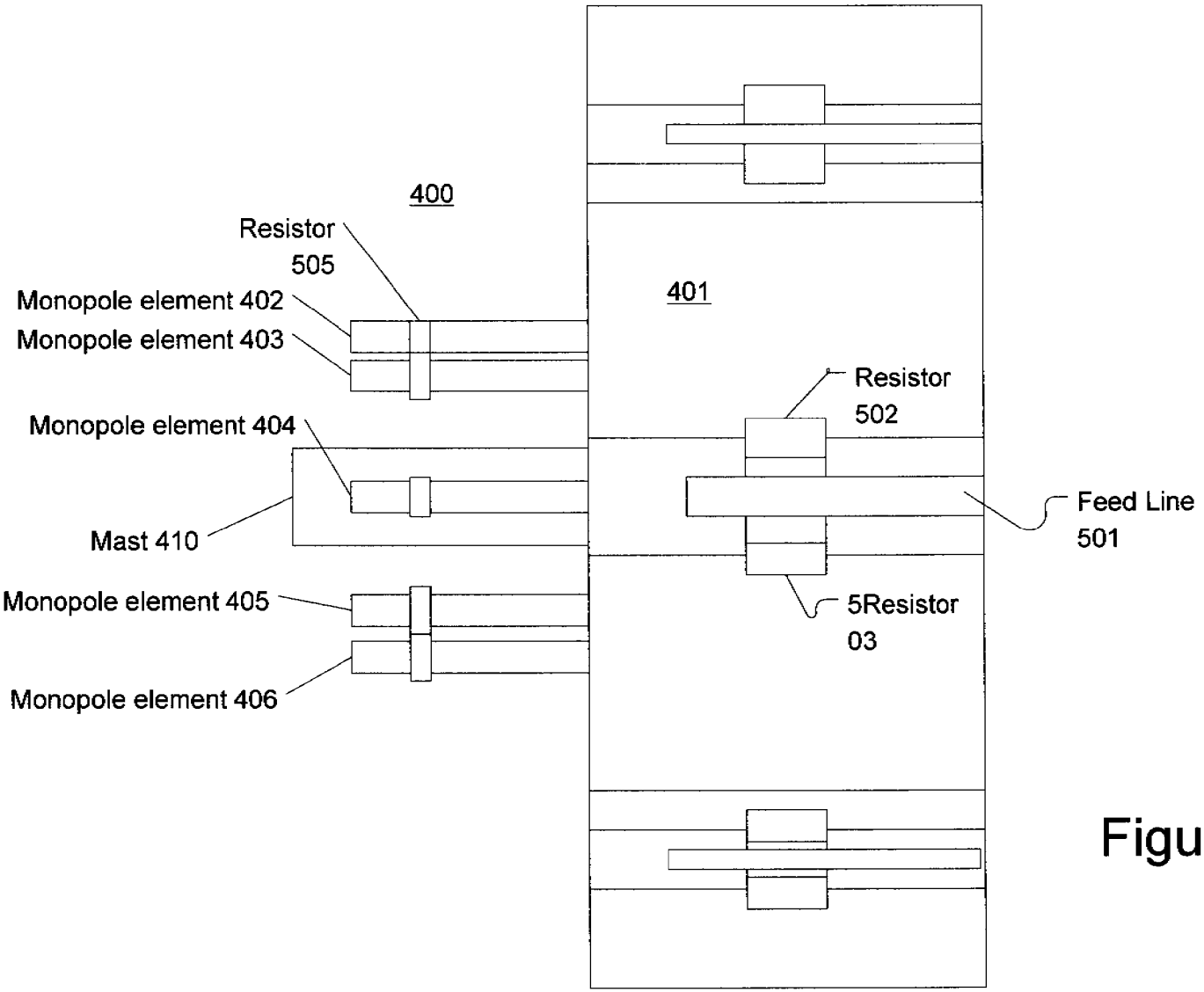
FIG. 5 illustrates a horizontal view of an edge-radiating antenna in accordance with an embodiment.

FIG. 4 illustrates a cross section of edge-radiating antenna 400 in accordance with an embodiment. Edge-radiating antenna behaves like an edge slot antenna because the signals radiate from the edge of the antenna. The edge-radiating antenna is formed by two plates, an upper plate and a lower plate (not shown), tied together by a concentric cylinder 401 to form a short circuit. Edge-radiating antenna 400 may be modified for two band operation by adding a circular array of eight monopoles 402-409 in an array with a center mast 410 modified so no resonance occurs on the upper plate. These monopole outputs are then connected to a beam forming network (discussed infra) to obtain the omni, sine, and cosine direction finding antenna patterns. FIG. 5 illustrates a horizontal view of edge-radiating antenna 400. This view demonstrates that there is a resistor 505 disposed at the end of each of the monopole elements, for example, 402. Furthermore, this view demonstrates that there are eight feed points at the outside edge of cylinder 401 with a feed line 501 extending from the bottom edge to the top edge for each feed point. Feed point impedance is stabilized by adding left shunt resistor 502 and right shunt resistor 503 across a feed gap in the feed region. With this configuration, a bandwidth in excess of 20:1 may be achieved.

Modified Vivaldi Biconical Structure

In an embodiment, an antenna may be modified by adding biconical flares to increase the bandwidth even further. In one example, a bandwidth of 100:1 may be achieved at the lowest frequency of operation where the aperture is 3% of a wavelength. Edge termination is applied to the outer edges of biconical flares to achieve this wide bandwidth, along with feed structure improvements. Feed structure improvements include modification of the Vivaldi rib taper and adding a resistor to the rib termination, replacing the short circuit normally used. Also, a ferrite bead is added through the center to allow cables to pass through from top to bottom.

A typical Vivaldi launch is modified to operate below its normal cutoff frequency. The matching network is changed from a short circuit to using a high impedance resistor to replace the short circuit. This allows fields to propagate into the biconical section. The vertical height of the structure is approximately one foot, therefore an aperture termination strip using resistors in shunt with each other and spaced around the top and bottom allows the waves to propagate in and out without mismatches. At the high end of the band (30 Mhz to 3 Ghz), the resistors on the aperture are not seen by the propagating wave. The feed system is arranged internally so that the eight elements provide direction finding information to the matrix.

Figure 6A:
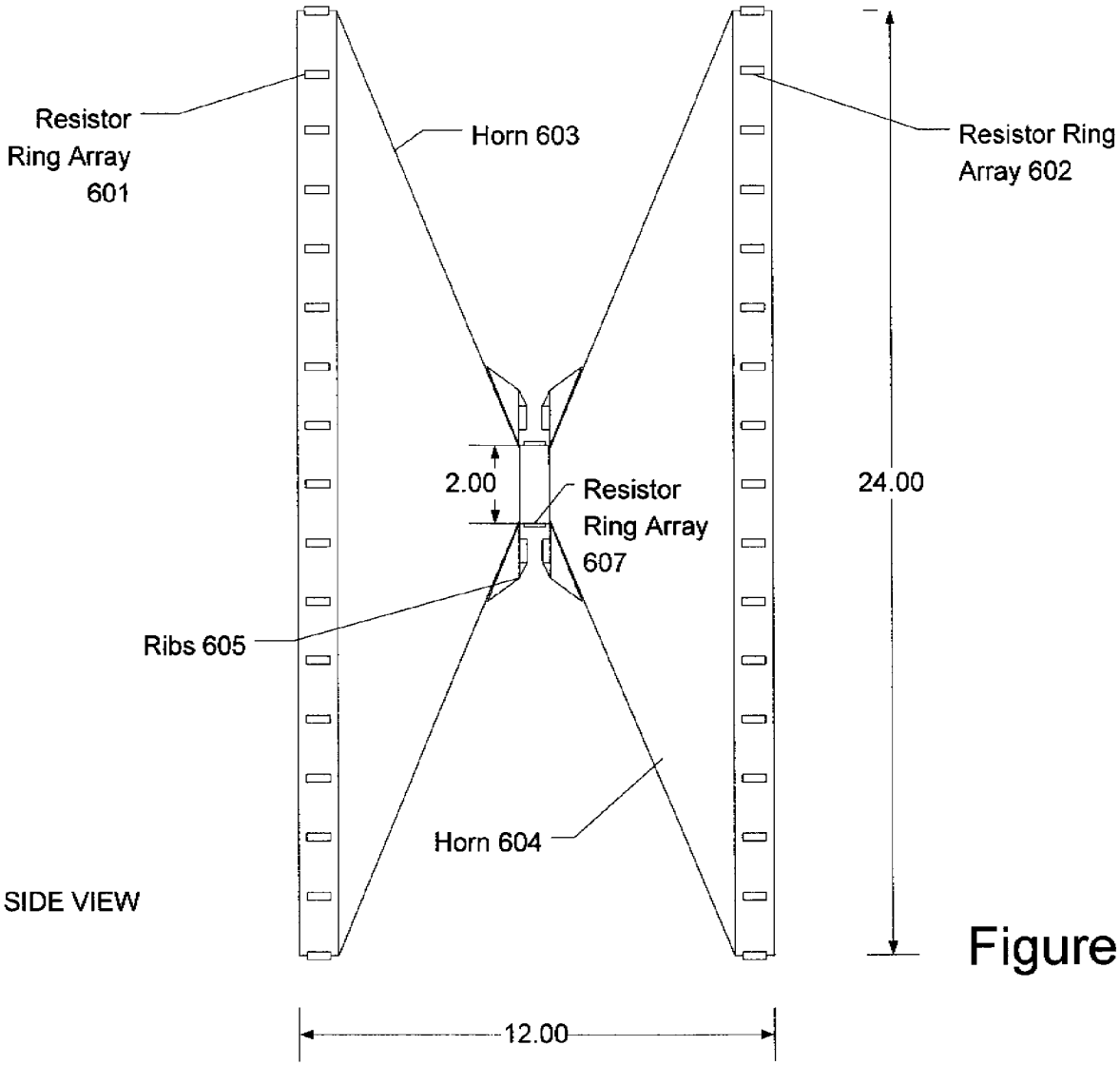
FIG. 6A illustrates a modified Vivaldi structure in accordance with an embodiment.
Figure 6B:
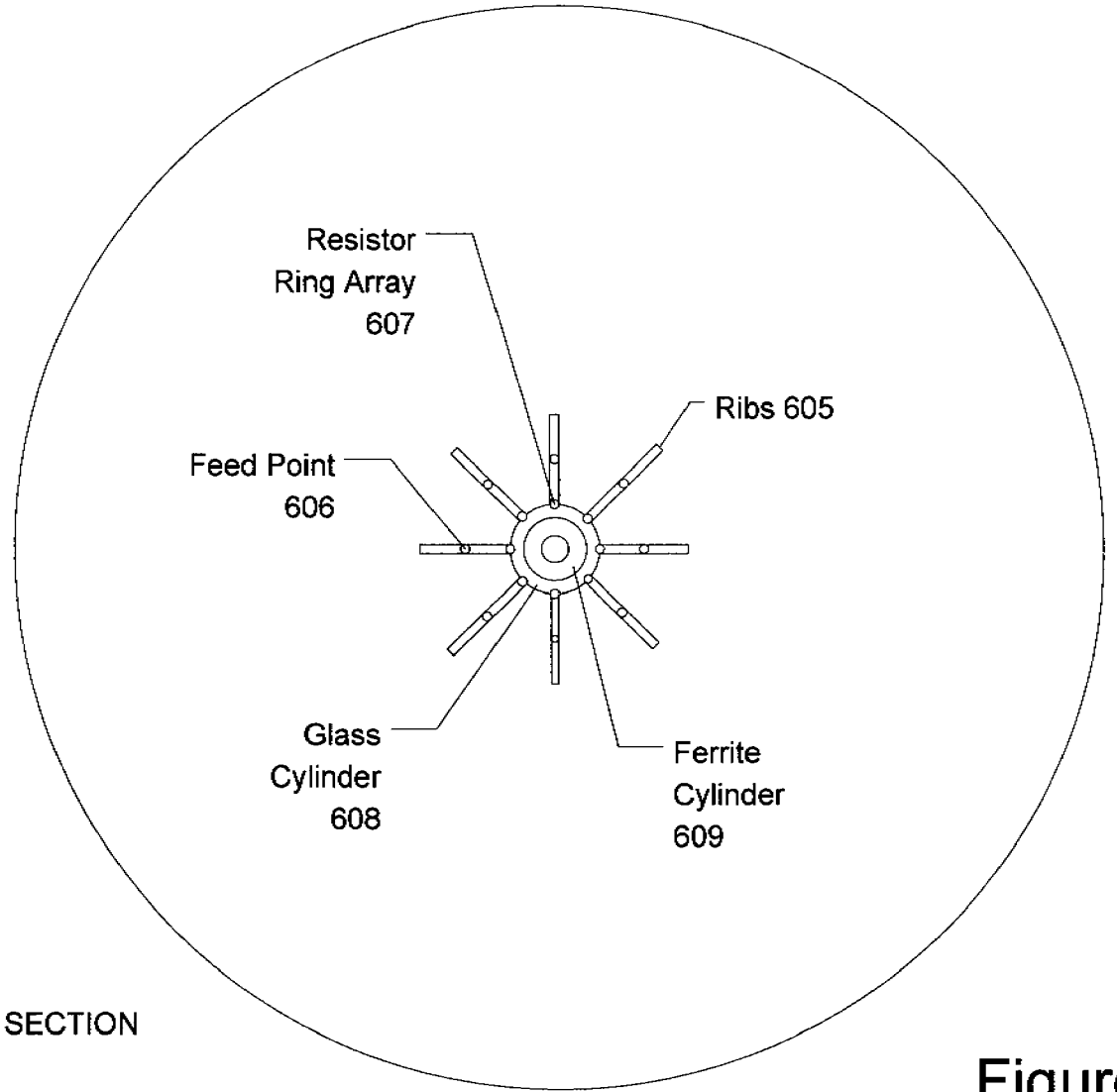
FIG. 6B illustrates a modified Vivaldi structure cross section view in accordance with an embodiment.

FIGS. 6A and 6B illustrates a side view and a cross section view, respectively, of a modified Vivaldi structure 600 in accordance with an embodiment. A first resistor ring array 601 and second resistor ring array 602 comprise low frequency resistor arrays that attach to the biconical horns 603 and 604. Biconical horns 603 and 604 each include eight launching ribs 605 in a radial placement at the top of each horn 603 and 604. Each launching rib 605 includes a feed point 606 across the rib 605, which connects to the matrix via a coaxial connection. The upper cone is a mirror image of the lower cone except the coaxial inputs in the lower cone ribs are short circuits in the upper cone ribs. Each rib 605 connects to a resistor in a third resistor array 607 that is disposed between horns 603 and 604 and around an epoxy glass cylinder 608 housing a ferrite cylinder 609. Third resistor array 607 replaces the short circuit in a typical Vivaldi element and thus allows the field to propagate in the biconical structure.

Figure 7A:
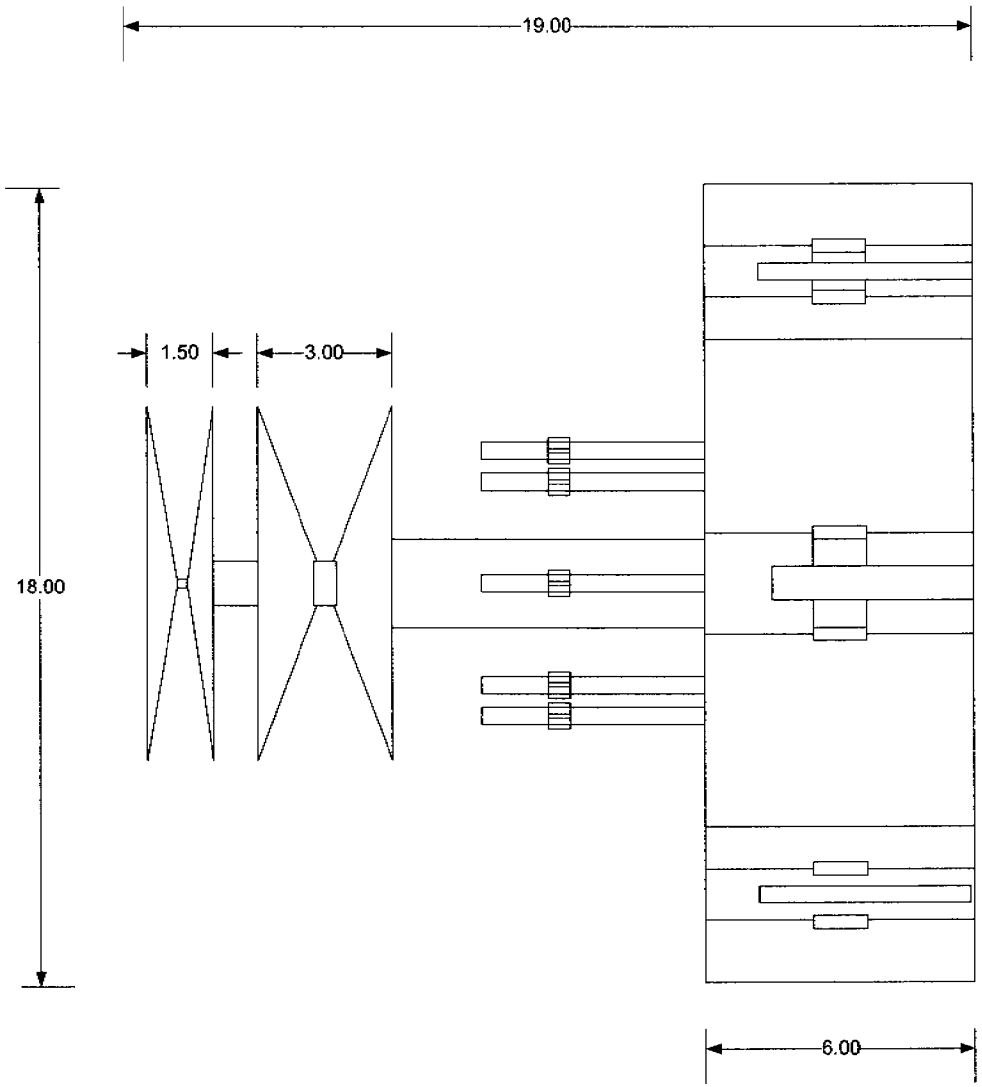
FIG. 7A illustrates stacked biconical antennas in accordance with an embodiment.
Figure 7B:
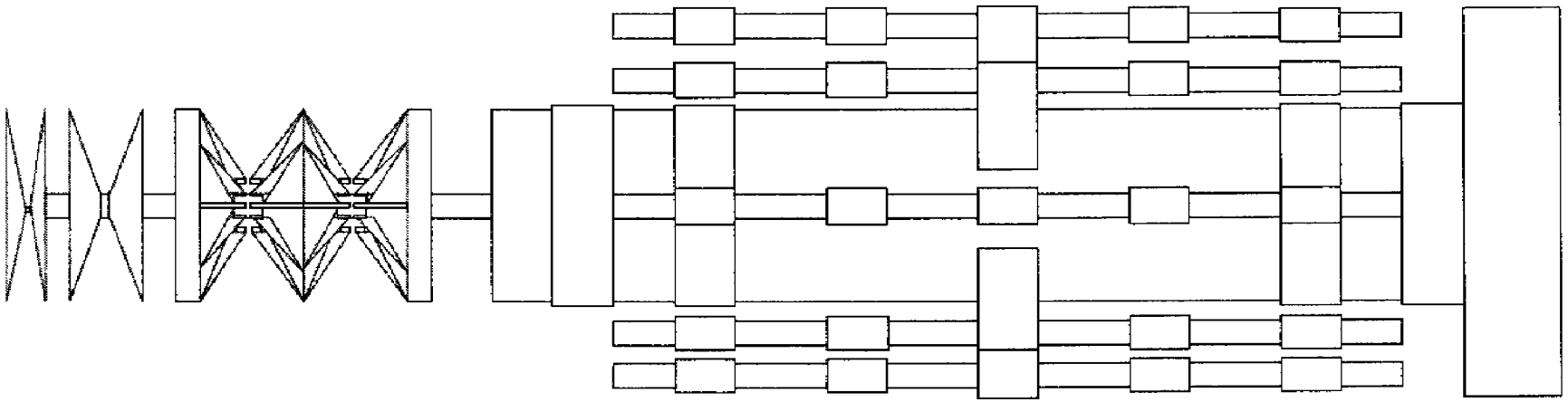
FIG. 7B illustrates stacked biconical antennas in accordance with an embodiment.

In another embodiment, bicones can also be stacked vertically as shown in FIG. 7A (measurements in inches). A broader band of coverage can be achieved according to an embodiment by vertically stacking a plurality of biconical antennas, e.g., 701 and 702. Each antenna would have a mode former to which the plurality of feed elements is connected, as previously discussed herein. In one embodiment, biconical antennas 701 and 702 are stacked in conjunction with edge-radiating antenna 703, previously described with reference to FIGS. 4 and 5. FIG. 7B illustrates another embodiment in which biconical antennas 701 and 702 are stacked in conjunction with a stacked Modified Vivaldi array 705, previously described with reference to FIGS. 6A and 6B, and further in conjunction with a dipole array antenna 707, previously described with reference to FIGS. 1-3. In one embodiment, high frequency direction finding component 709 is also included. Vertically stacking a plurality of such antennas provides direction-finding accuracy over a broad frequency range, since each antenna is designed to accommodate a particular frequency range.

Direction Finding Matrix

In one embodiment, the beam forming network for a circular direction finding array consists of 8 antenna array elements on the input and three antenna patterns at the output. The input array element patterns are equal amplitude and circularly disposed around the array. The input array elements may be dipoles, monopoles, Vivaldi elements, or any other type of element suitable for summing.

The output antenna patterns are omni, sine, and cosine patterns. The omni pattern is the sum of all 8 elements. The sine and cosine patterns are the difference of opposed sums of elements (opposite pairs), as explained below. The sine and cosine patterns provide for angularly offset patterns in amplitude and phase, whereas the omni pattern is of uniform amplitude and phase about the circular array.

Instead of the 4×3 beam finding matrix typically used, this embodiment includes an 8×3 matrix. The sine, cosine, and omni outputs allow the voltage vectors to analyzed to determine direction of arrival. Information appears at each port of the matrix instantaneously. Thus, the matrix can find signals that are only on for short periods of time. This embodiment does not need to store information to process the signals for direction finding.

Figure 8:
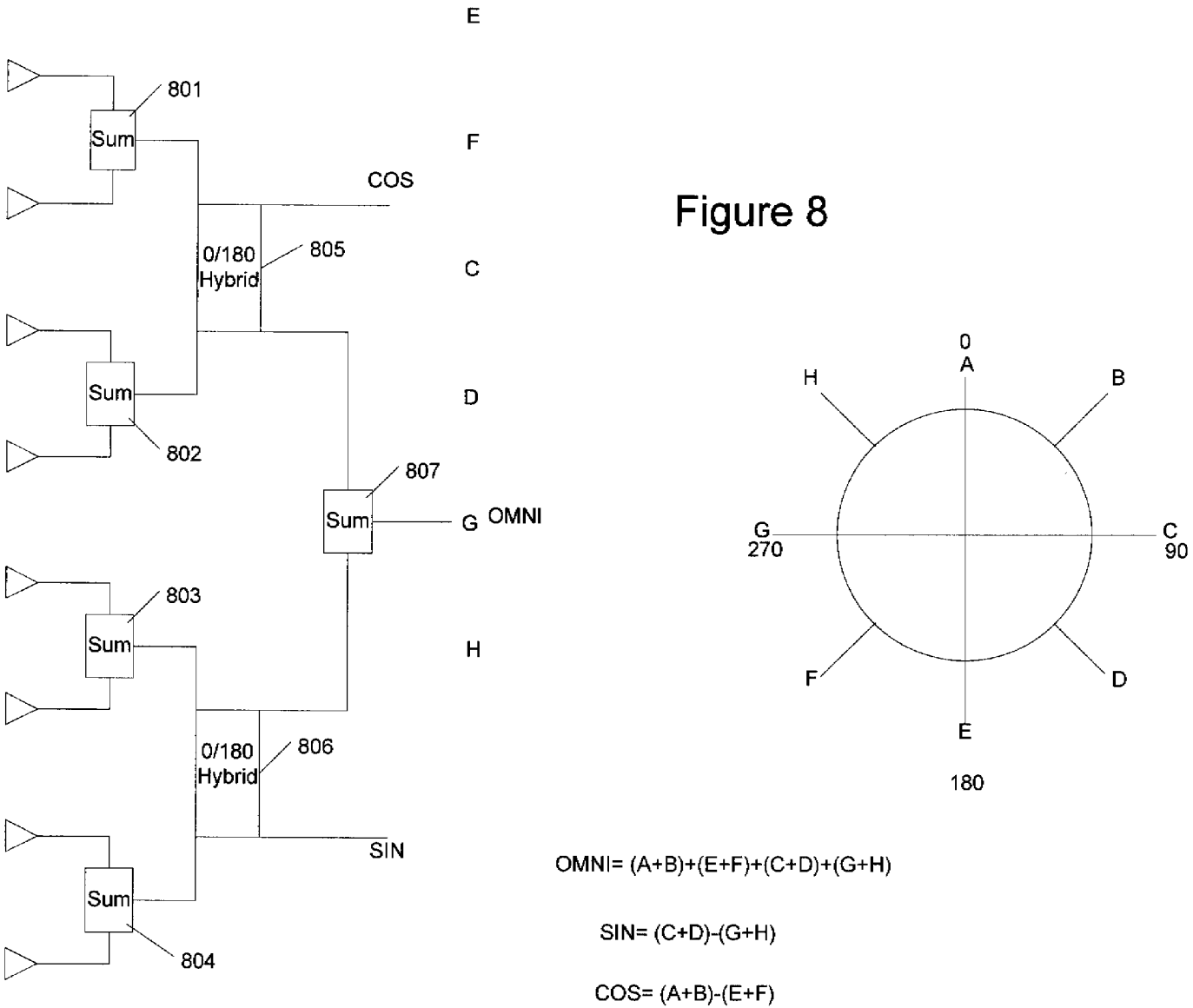
FIG. 8 illustrates a block diagram of the beam finding matrix in accordance with an embodiment.

FIG. 8 illustrates a block diagram of the beam finding matrix in accordance with an embodiment. Elements A-H represent the circular array of 8 antenna elements, where the angle of elements A-H is as follows: A=0°, B=45°, C=90°, D=135°, E=180°, F=225°, G=270°, and H=315°. Elements A and B are summed by power divider 801, elements E and F are summed by power divider 802, elements C and D are summed by power divider 803, and elements G and H are summed by power divider 804. Next, 0/180 hybrid element 805 produces a sum and delta (difference) signal for the A+B signal and the E+F signal, the delta of which is the cosine pattern COS=(A+B)−(E+F). This produces a null position halfway between signals, i.e., 180°. Then, 0/180 hybrid element 806 produces a sum and delta signal for the C+D signal and the G+H signal, the delta of which is the sine pattern SIN=(C+D)−(G+H). This produces a second null position halfway between the other null position, thus creating a 90° space. The sum signals of the 0/180 hybrid elements 805 and 806 are then summed by power divider 807 to produce the omni pattern OMNI=(A+B)+(E+F)+(C+D)+(G+H). The magnitude indicates the direction and the phase indicates the quadrant, thus allowing direction finding.

On the Move ("OTM")

Typical OTM antennas use monopole elements. In this case, whatever the OTM antenna is mounted on becomes part of the antenna. In one embodiment, monopoles are made to look like dipoles electrically so that the object the OTM is mounted on is no longer part of the antenna. An OTM in accordance with this embodiment may be mounted on a vehicle, boat, or aircraft. An OTM in accordance with this embodiment may operate at 30 MHz, while only being 31 inches in length.

Figure 9:
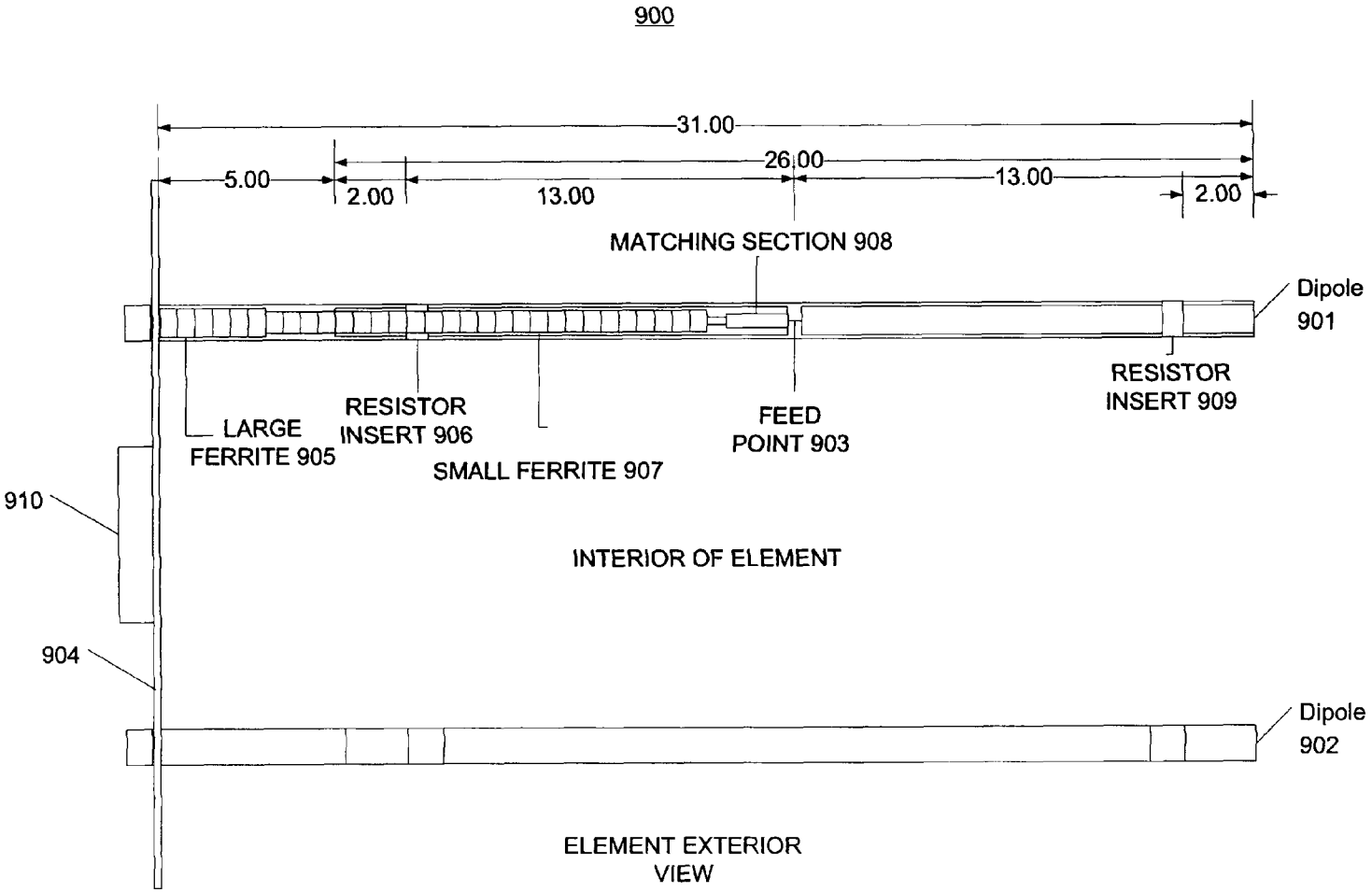
FIG. 9 illustrates an On-the-Move antenna in accordance with an embodiment.

FIG. 9 illustrates an OTM antenna 900 in accordance with an embodiment. OTM antenna 900 includes dipole elements 901, 902, and two other dipole elements that are not shown in this view. Dipole element 901 is shown in cross section, while dipole element 902 is show as an exterior view. The dipole elements include a feed point 903 located 26 inches from base 904. A large ferrite 905 is located at the base 904. In one embodiment, a resistor insert 906 is located approximately 7 inches from base 904. A small ferrite 907 is disposed between resistor insert 906 and matching section 908. In one embodiment, a second resistor insert is located approximately 2 inches from the end of dipole 901. The dipole elements feed into a 4×3 direction finding matrix 910. By adding the ferrites and suppressing currents in the base 904 and cables (not shown), the antenna impedance is isolated. This method of isolation allows for a much shorter height than OTM antennas of the prior art.

Experimental Data

Figure 10:
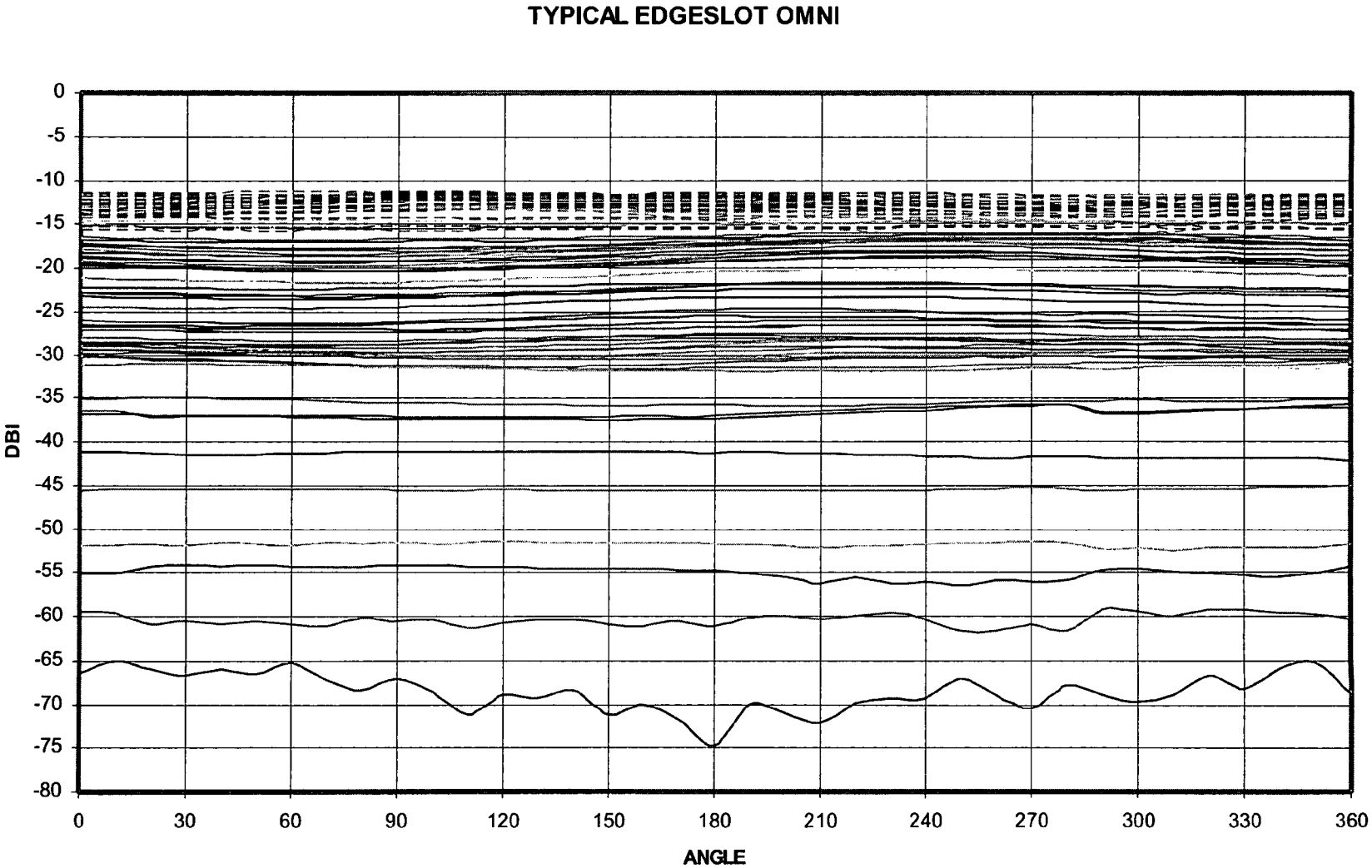
FIG. 10 illustrates OMNI pattern angle data from an edge-radiating antenna in accordance with an embodiment.
Figure 11:
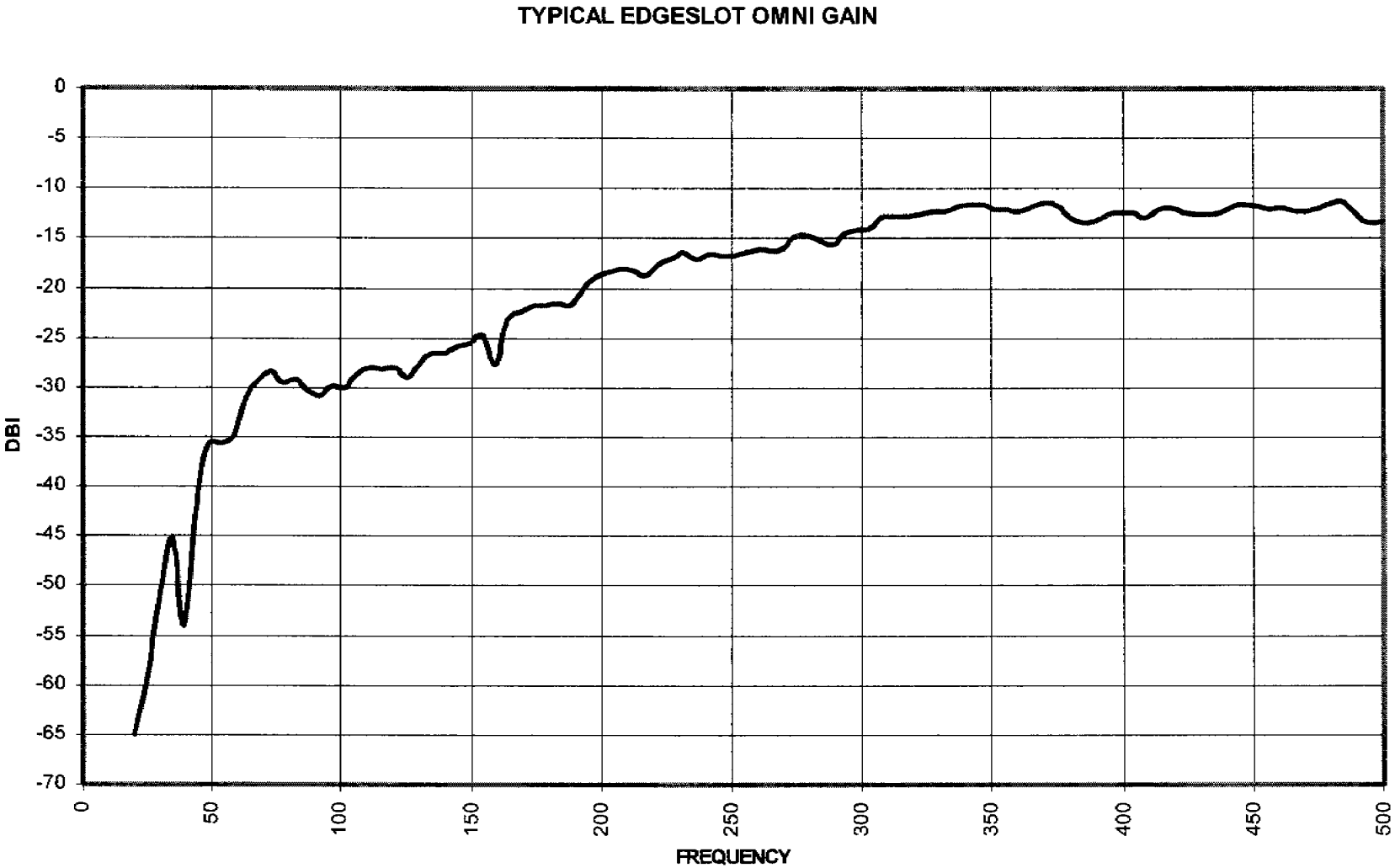
FIG. 11 illustrates OMNI pattern frequency gain data from an edge-radiating antenna in accordance with an embodiment.
Figure 12:
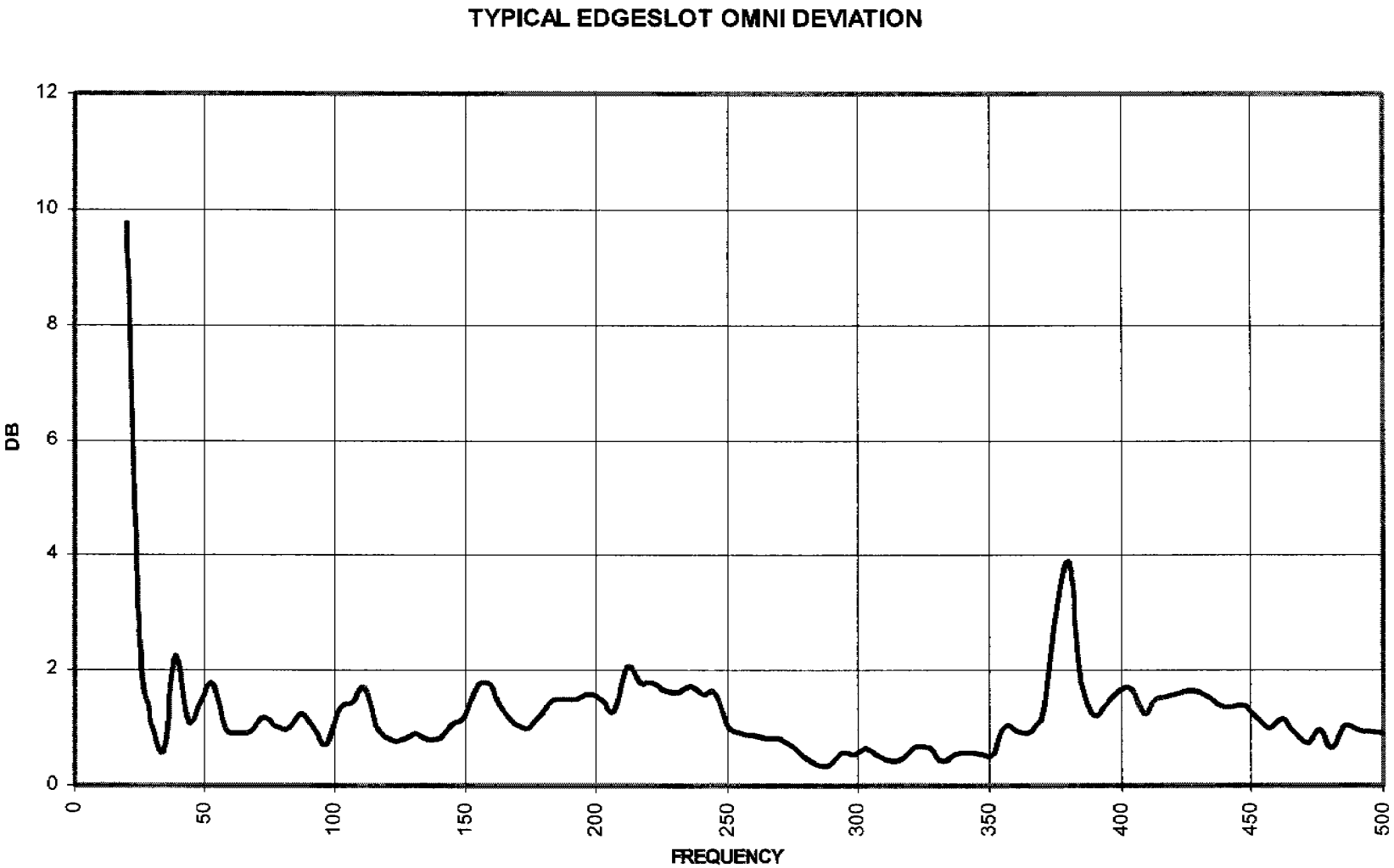
FIG. 12 illustrates OMNI pattern frequency deviation data from an edge-radiating antenna in accordance with an embodiment.
Figure 13:
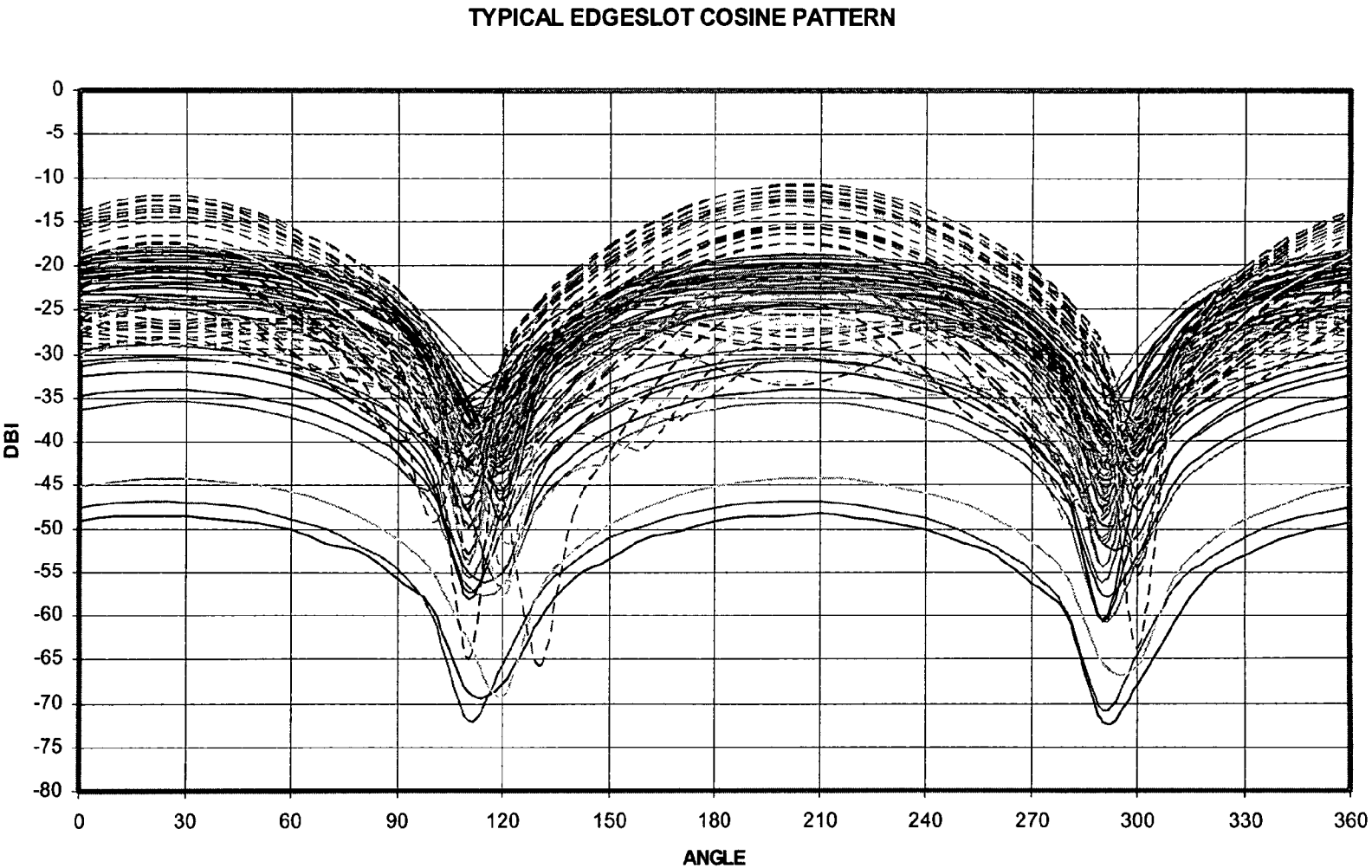
FIG. 13 illustrates COSINE pattern angle data from an edge-radiating antenna in accordance with an embodiment.
Figure 14:
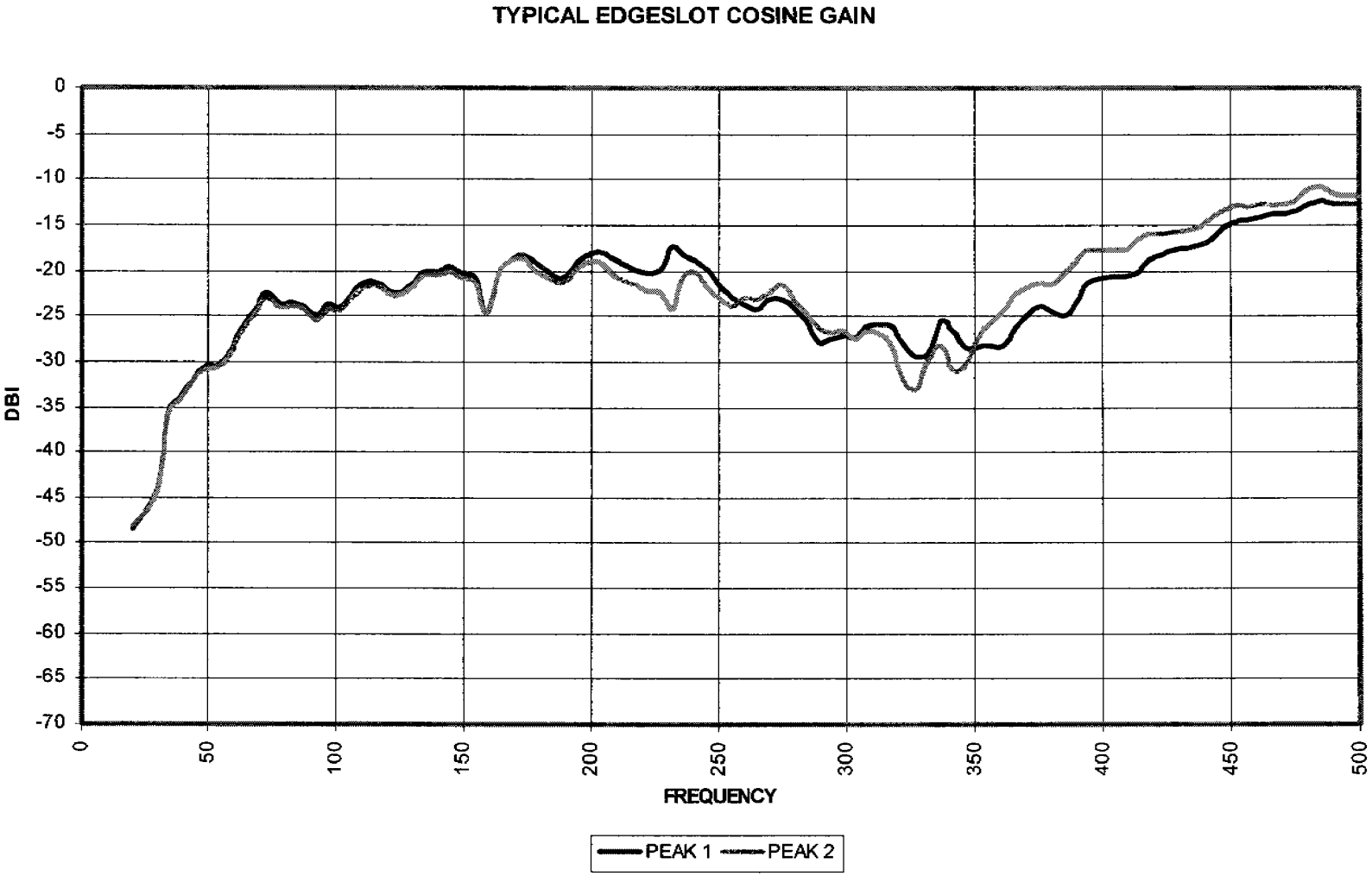
FIG. 14 illustrates COSINE pattern frequency gain data from an edge-radiating antenna in accordance with an embodiment.
Figure 15:
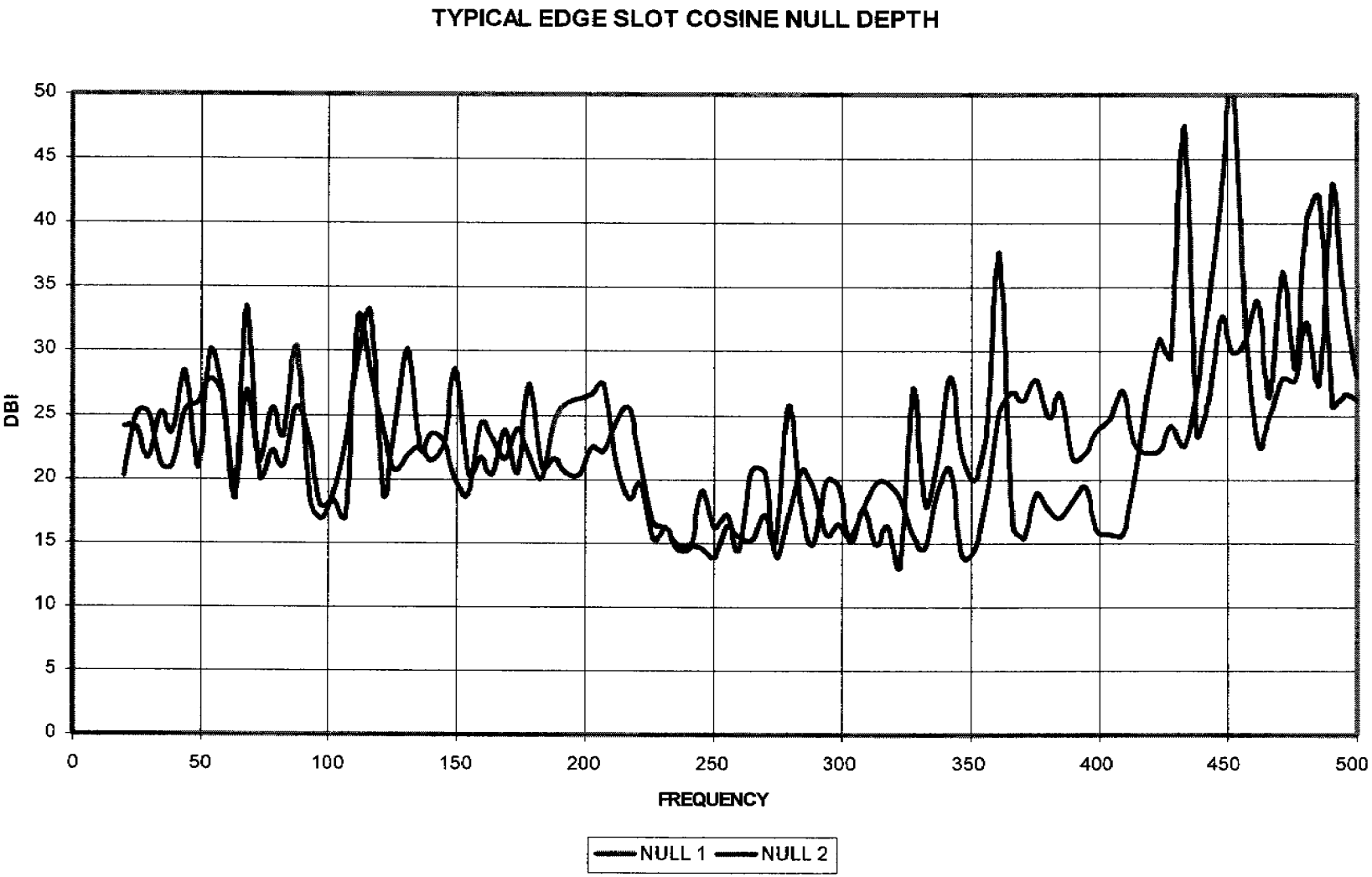
FIG. 15 illustrates COSINE pattern null depth data from an edge-radiating antenna in accordance with an embodiment.
Figure 16:
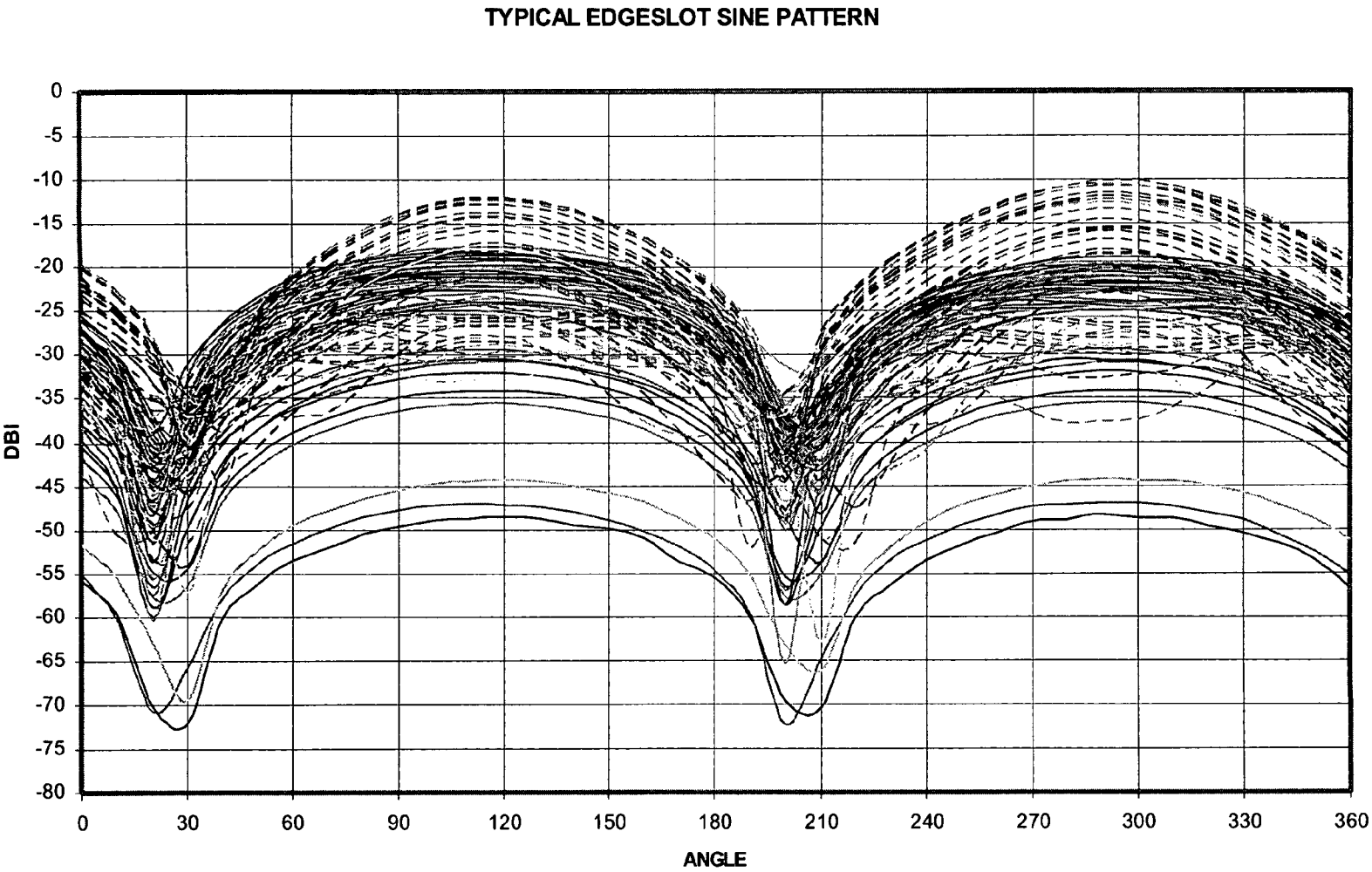
FIG. 16 illustrates SINE pattern angle data from an edge-radiating antenna in accordance with an embodiment.
Figure 17:
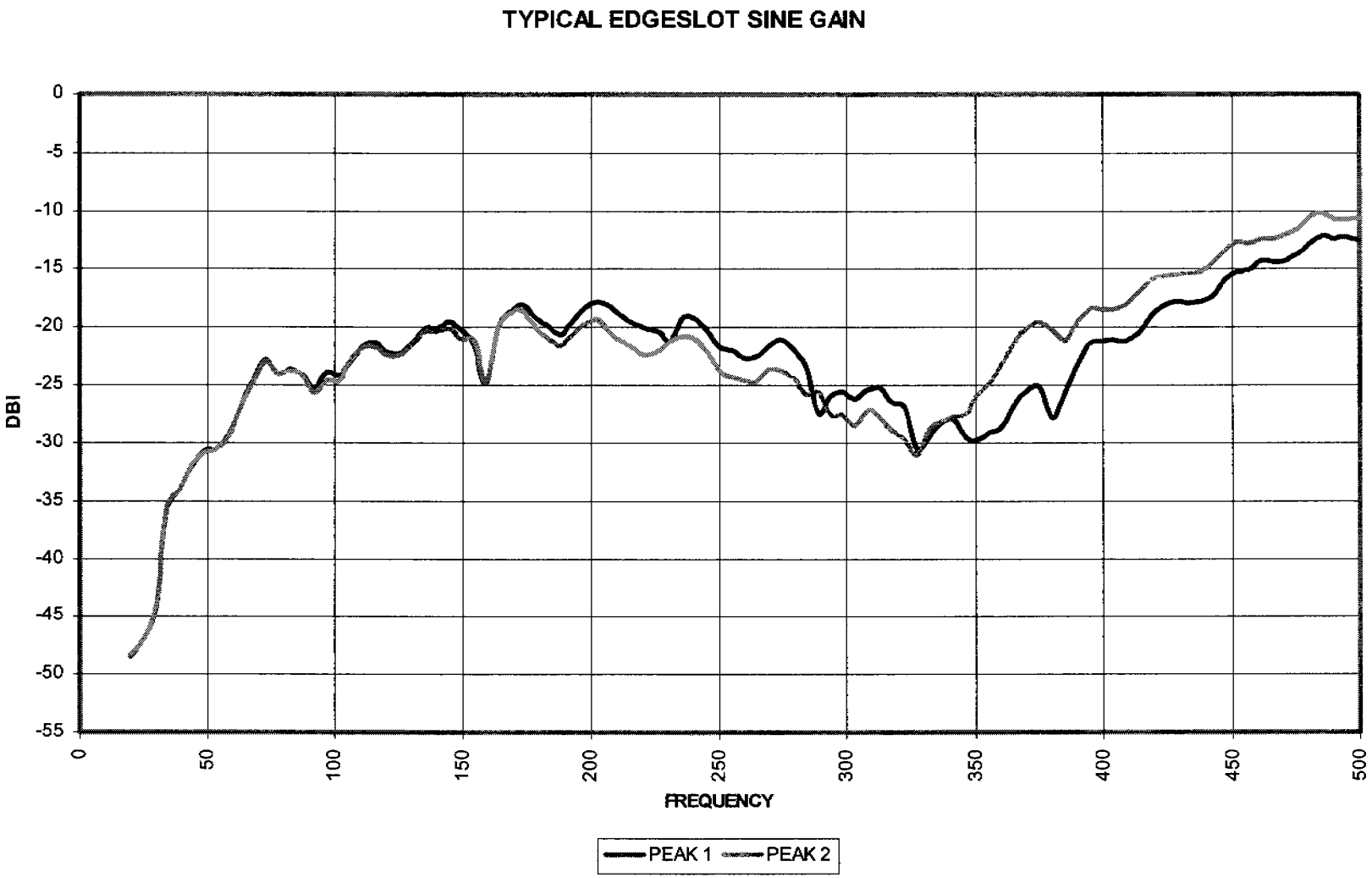
FIG. 17 illustrates SINE pattern frequency gain data from an edge-radiating antenna in accordance with an embodiment.
Figure 18:
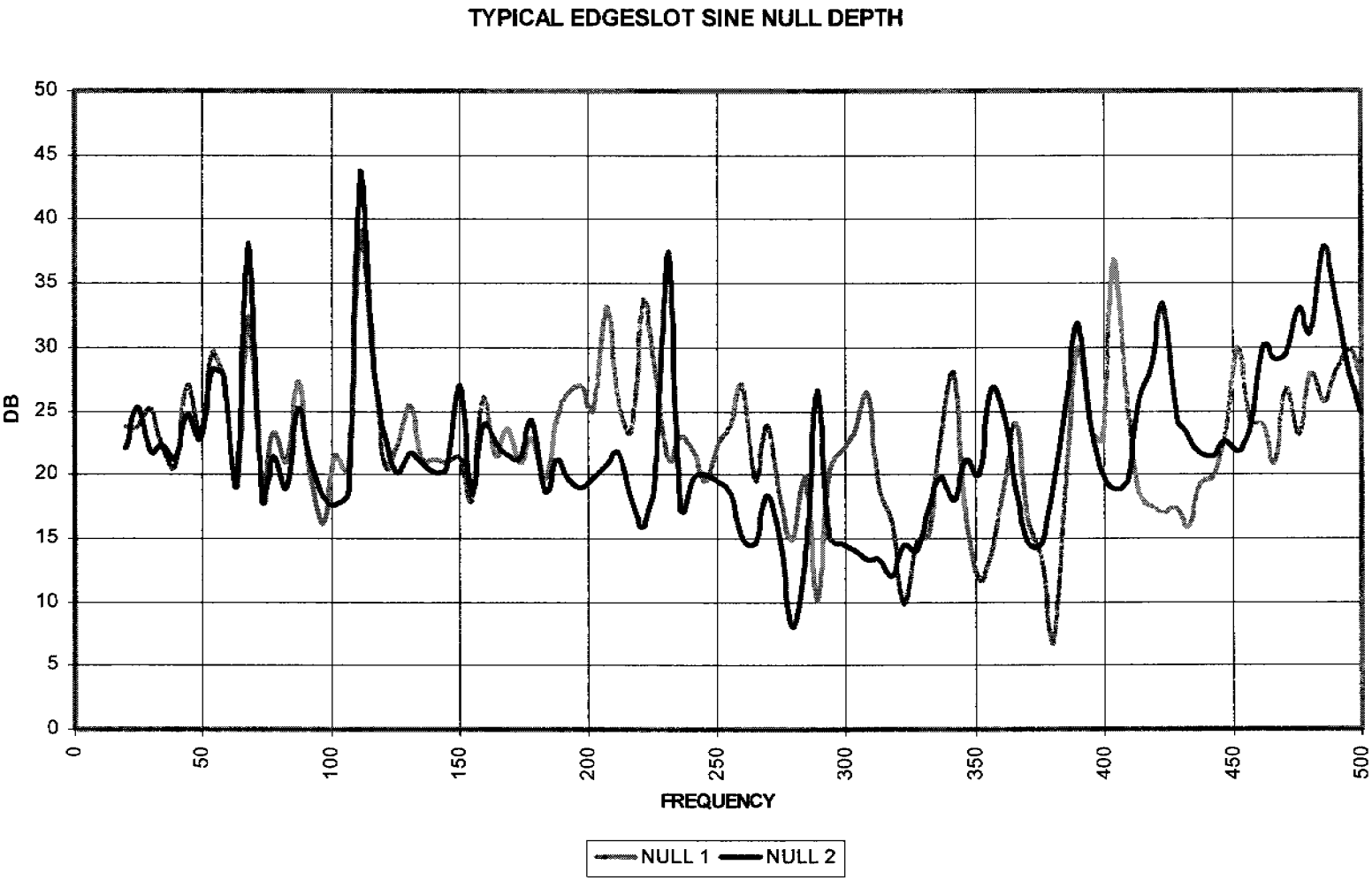
FIG. 18 illustrates SINE pattern null depth data from an edge-radiating antenna in accordance with an embodiment.

FIGS. 10-3 illustrate example pattern data acquired from various embodiments of antennas discussed above. FIG. 10 illustrates OMNI pattern angle data from an edge-radiating antenna such as edge-radiating antenna 400 discussed above. FIG. 11 illustrates OMNI pattern frequency gain data from an edge-radiating antenna such as edge-radiating antenna 400 discussed above. FIG. 12 illustrates OMNI pattern frequency deviation data from an edge-radiating antenna such as edge-radiating antenna 400 discussed above. FIG. 13 illustrates COSINE pattern angle data from an edge-radiating antenna such as edge-radiating antenna 400 discussed above. FIG. 14 illustrates COSINE pattern frequency gain data from an edge-radiating antenna such as edge-radiating antenna 400 discussed above. FIG. 15 illustrates COSINE pattern null depth data from an edge-radiating antenna such as edge-radiating antenna 400 discussed above. FIG. 16 illustrates SINE pattern angle data from an edge-radiating antenna such as edge-radiating antenna 400 discussed above. FIG. 17 illustrates SINE pattern frequency gain data from an edge-radiating antenna such as edge-radiating antenna 400 discussed above. FIG. 18 illustrates SINE pattern null depth data from an edge-radiating antenna such as edge-radiating antenna 400 discussed above.

Figure 19:
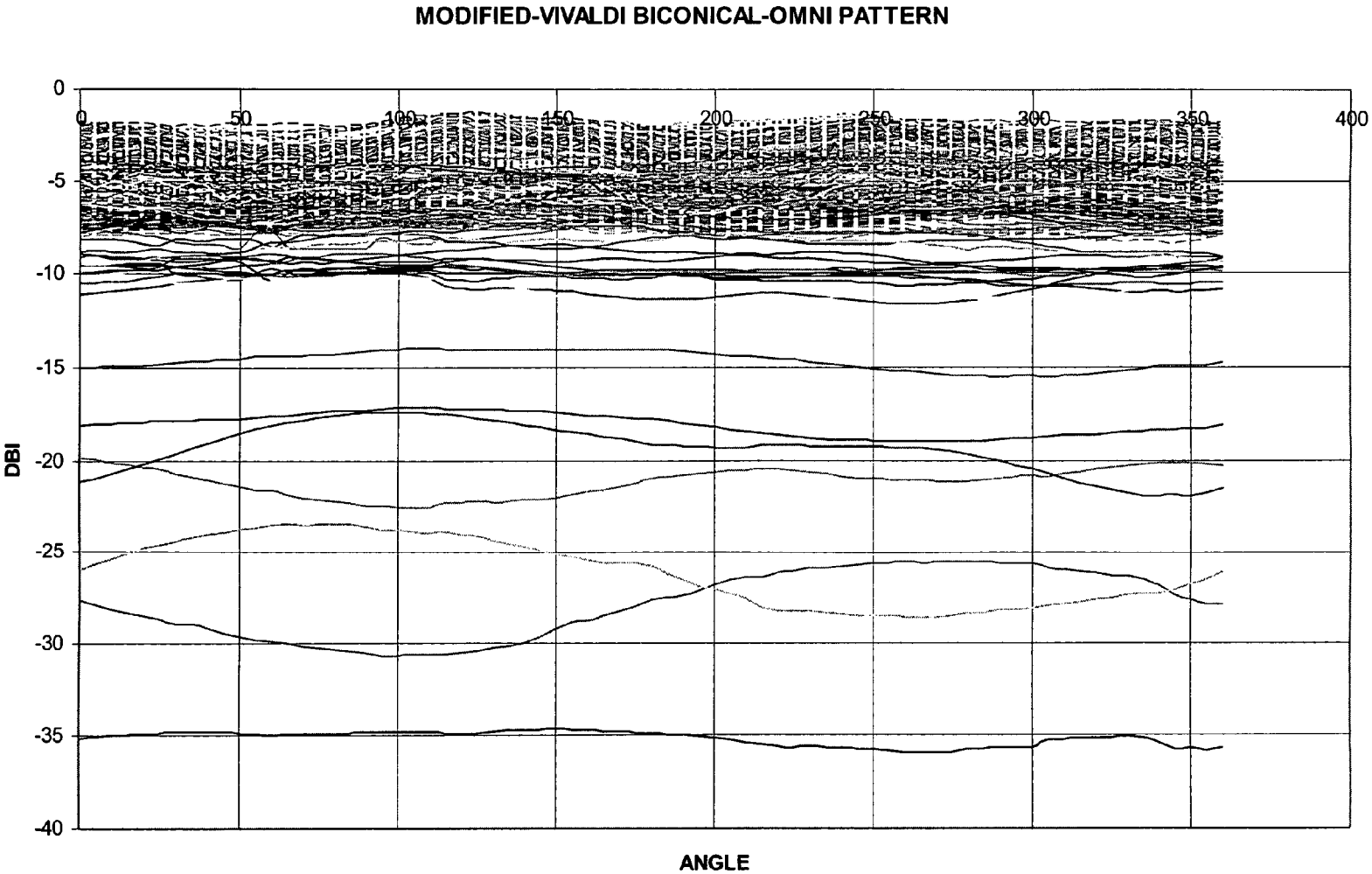
FIG. 19 illustrates OMNI pattern angle data from a modified Vivaldi biconical antenna in accordance with an embodiment.
Figure 20:
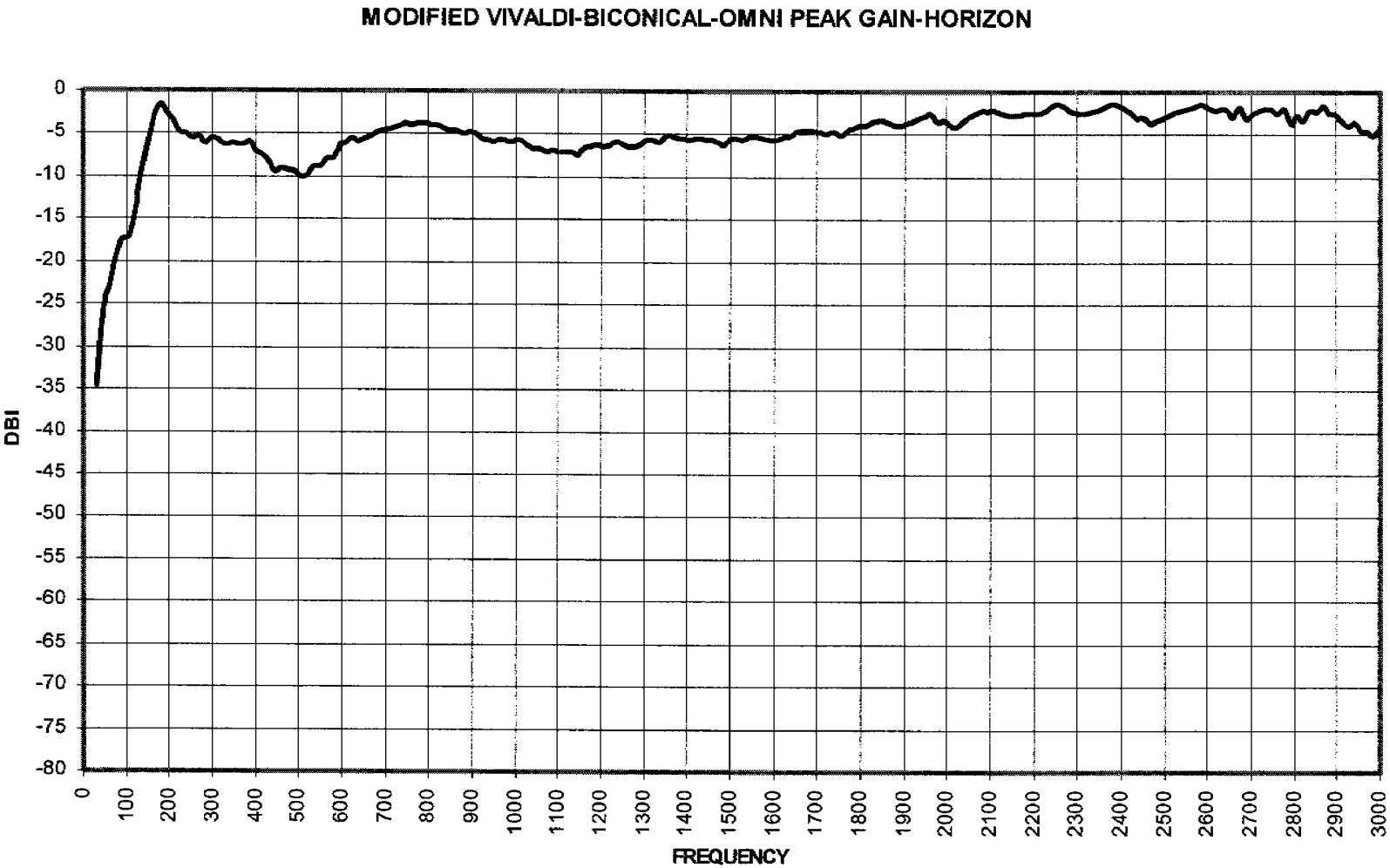
FIG. 20 illustrates OMNI pattern frequency gain data from a modified Vivaldi biconical antenna in accordance with an embodiment.
Figure 21:
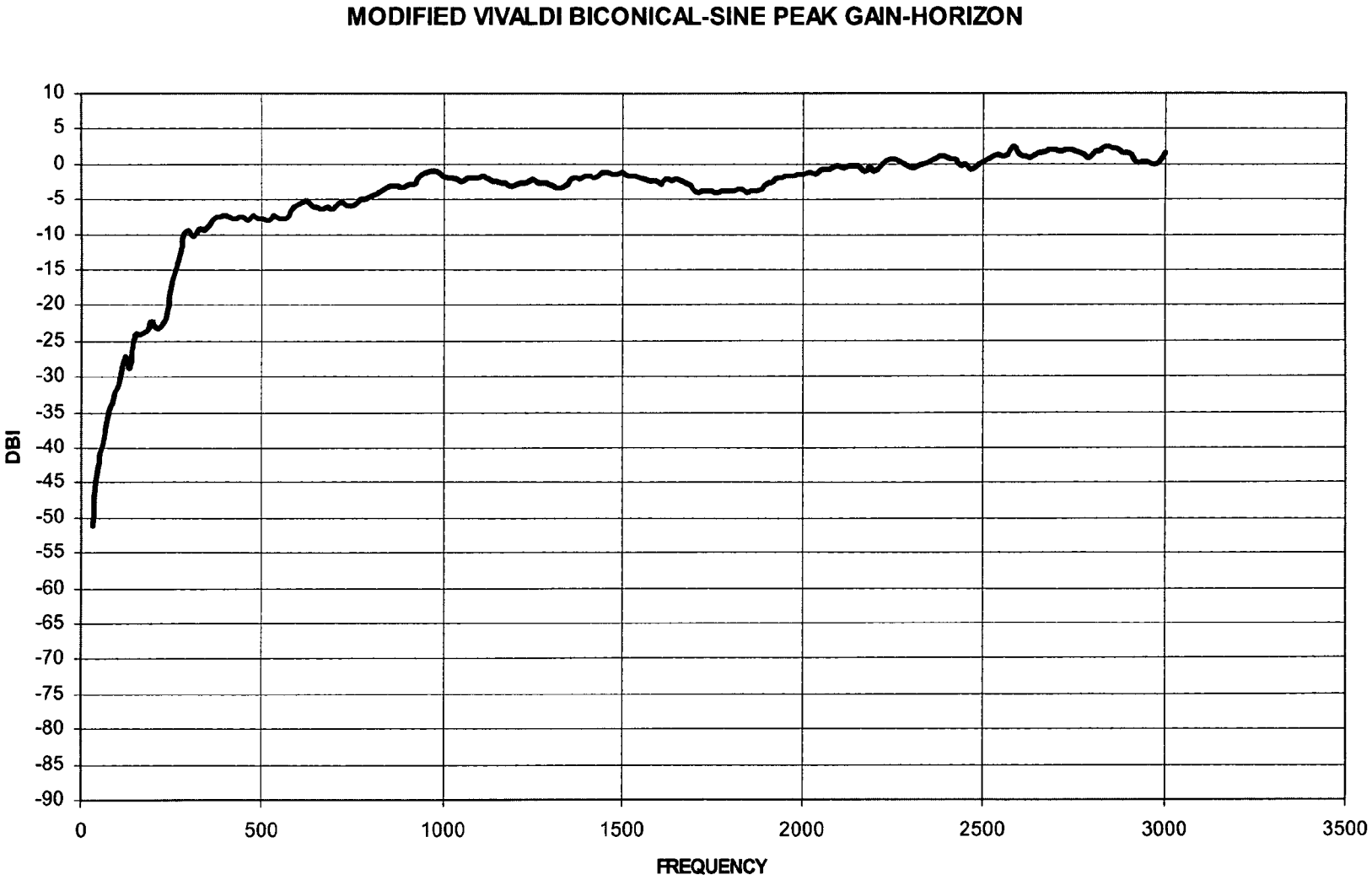
FIG. 21 illustrates SINE pattern frequency gain data from a modified Vivaldi biconical antenna in accordance with an embodiment.
Figure 22:
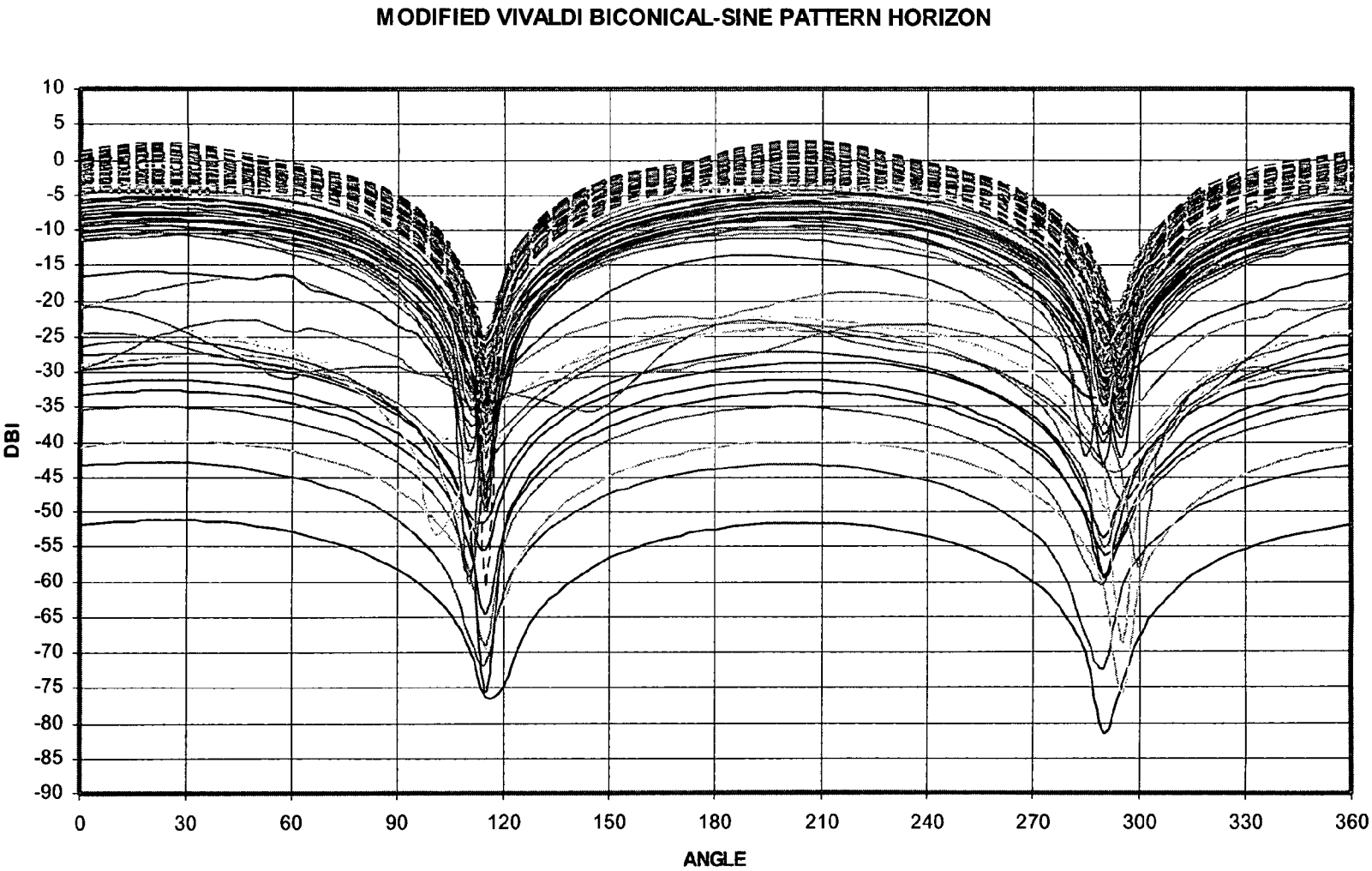
FIG. 22 illustrates SINE pattern angle data from a modified Vivaldi biconical antenna in accordance with an embodiment.
Figure 23:
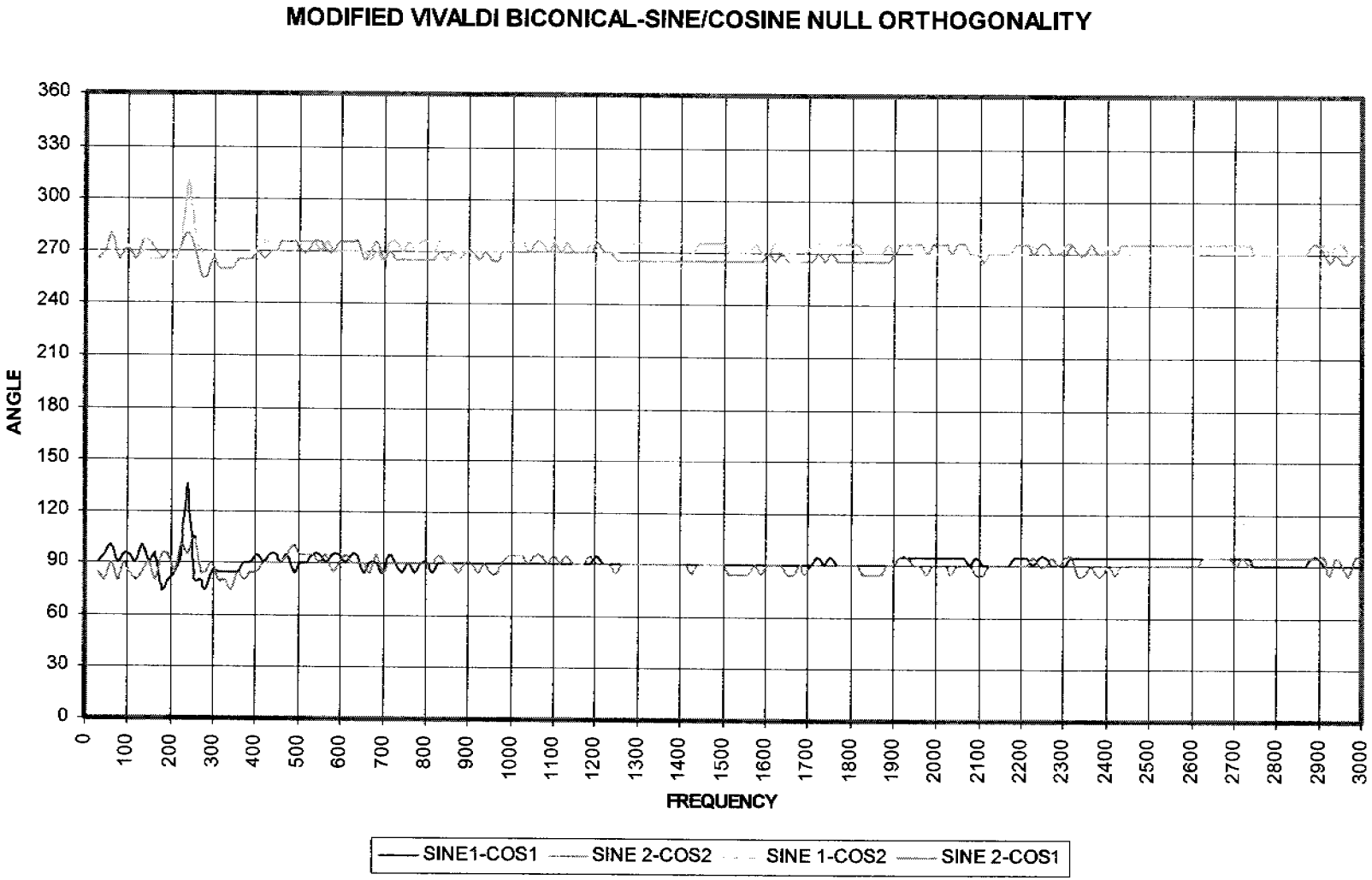
FIG. 23 illustrates SINE/COSINE null orthogonality data from a modified Vivaldi biconical antenna in accordance with an embodiment.
Figure 24:
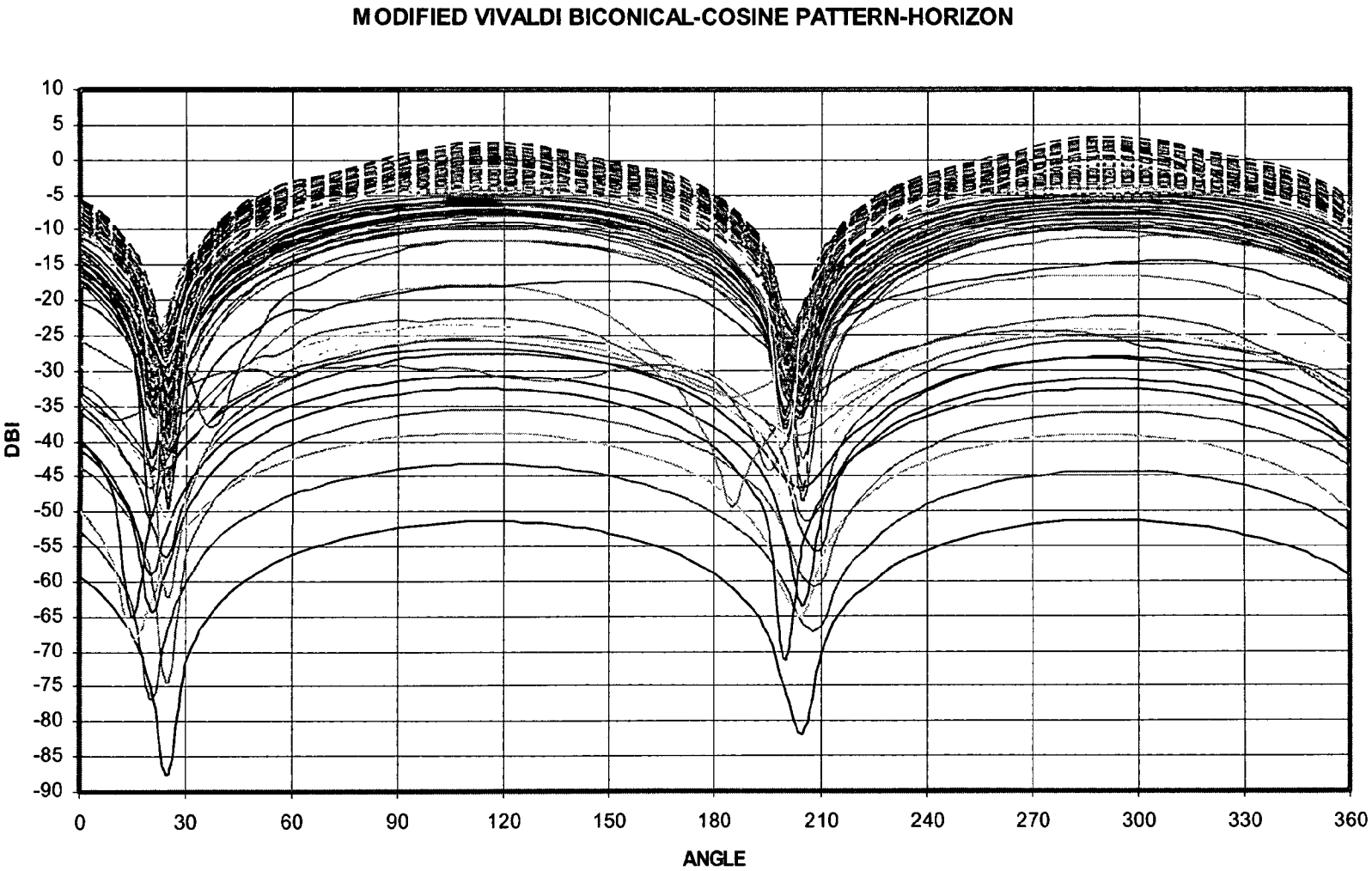
FIG. 24 illustrates COSINE pattern angle data from a modified Vivaldi biconical antenna in accordance with an embodiment.
Figure 25:
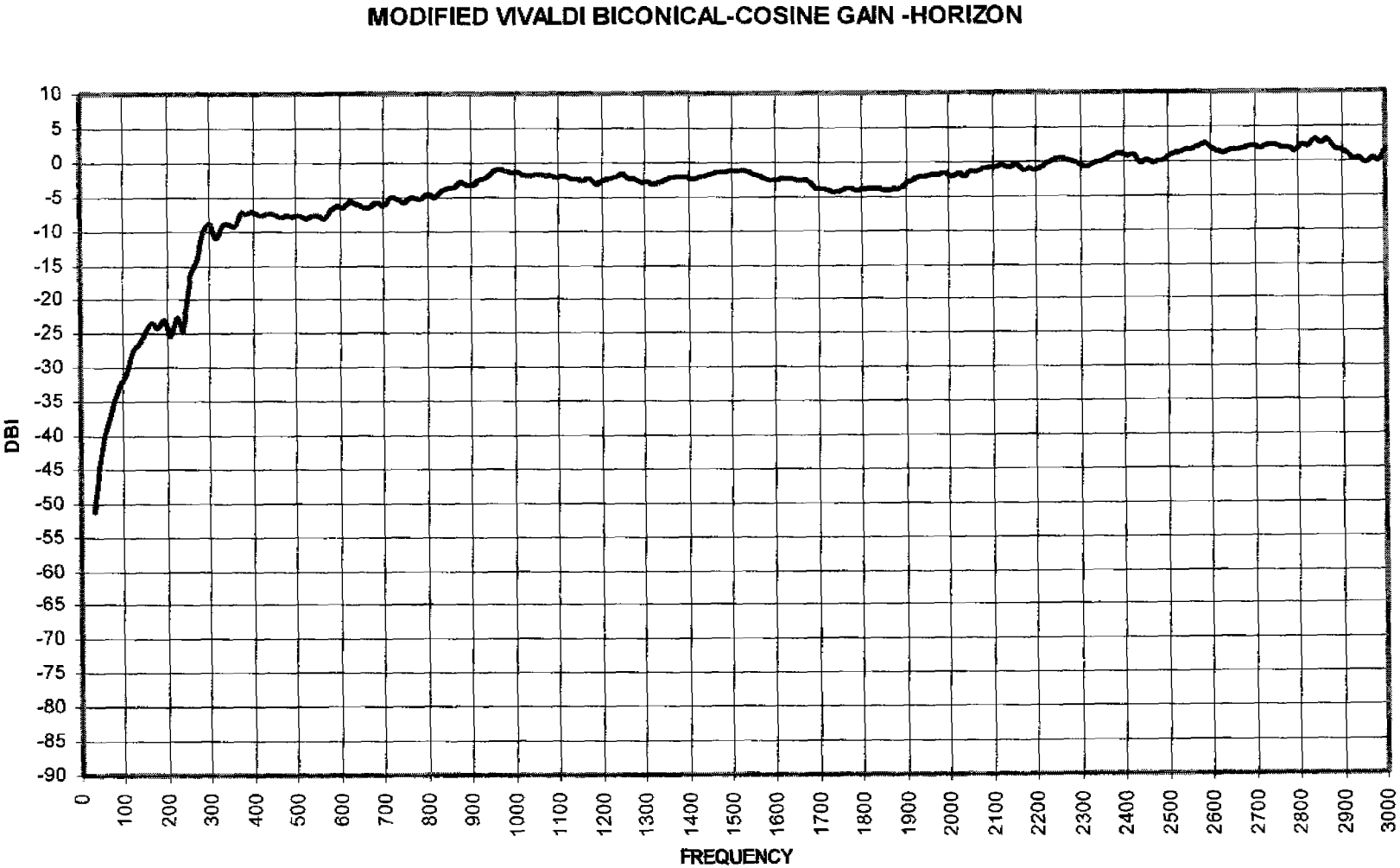
FIG. 25 illustrates COSINE pattern frequency gain data from a modified Vivaldi biconical antenna in accordance with an embodiment.

FIG. 19 illustrates OMNI pattern angle data from a modified Vivaldi biconical antenna such as modified Vivaldi biconical antenna 600 discussed above. FIG. 20 illustrates OMNI pattern frequency gain data from a modified Vivaldi biconical antenna such as modified Vivaldi biconical antenna 600 discussed above. FIG. 21 illustrates SINE pattern frequency gain data from a modified Vivaldi biconical antenna such as modified Vivaldi biconical antenna 600 discussed above. FIG. 22 illustrates SINE pattern angle data from a modified Vivaldi biconical antenna such as modified Vivaldi biconical antenna 600 discussed above. FIG. 23 illustrates SINE/COSINE null orthogonality data from a modified Vivaldi biconical antenna such as modified Vivaldi biconical antenna 600 discussed above. FIG. 24 illustrates COSINE pattern angle data from a modified Vivaldi biconical antenna such as modified Vivaldi biconical antenna 600 discussed above. FIG. 25 illustrates COSINE pattern frequency gain data from a modified Vivaldi biconical antenna such as modified Vivaldi biconical antenna 600 discussed above.

Figure 26:
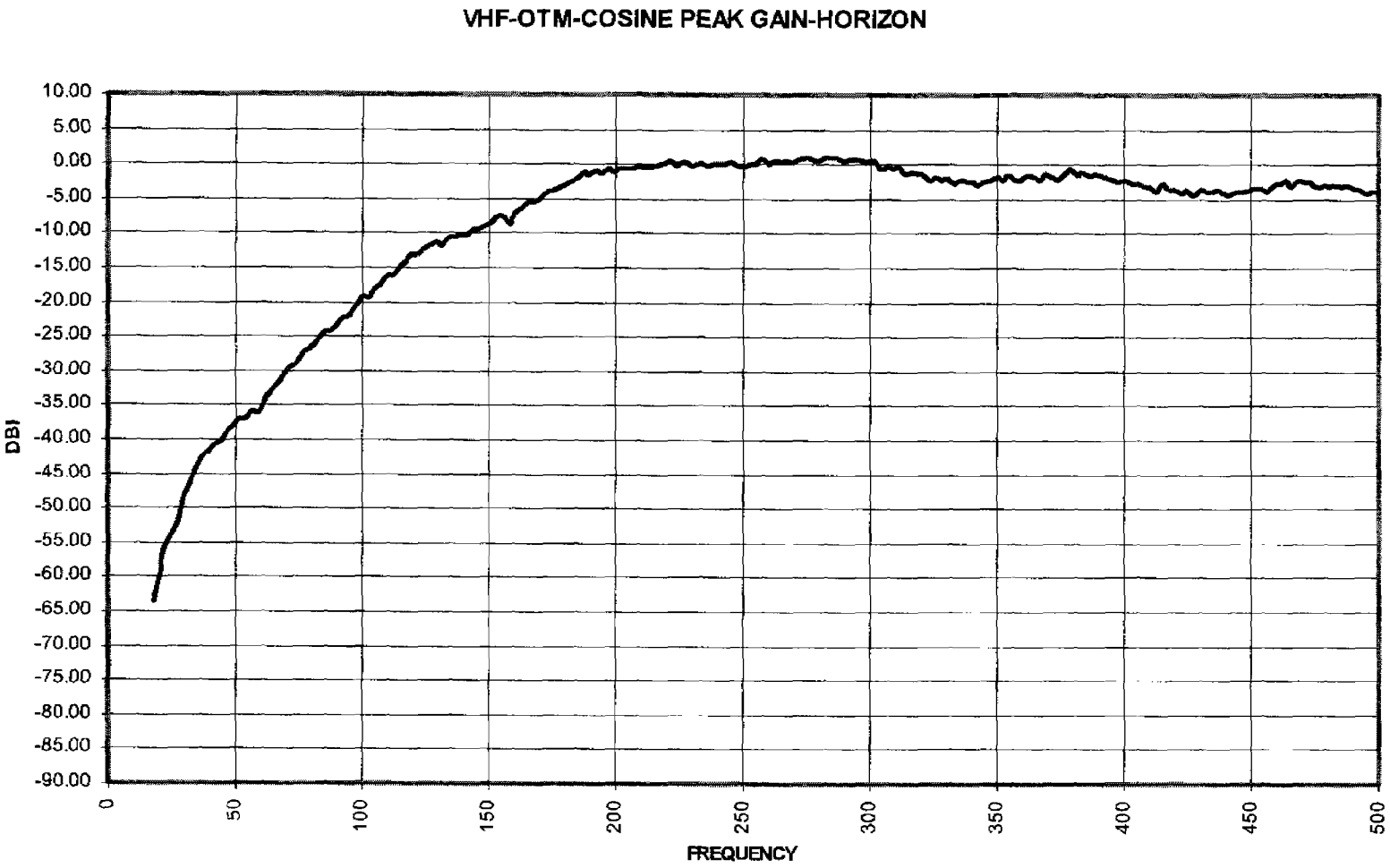
FIG. 26 illustrates COSINE pattern frequency gain data from an On-the-Move ("OTM") antenna in accordance with an embodiment.
Figure 27:
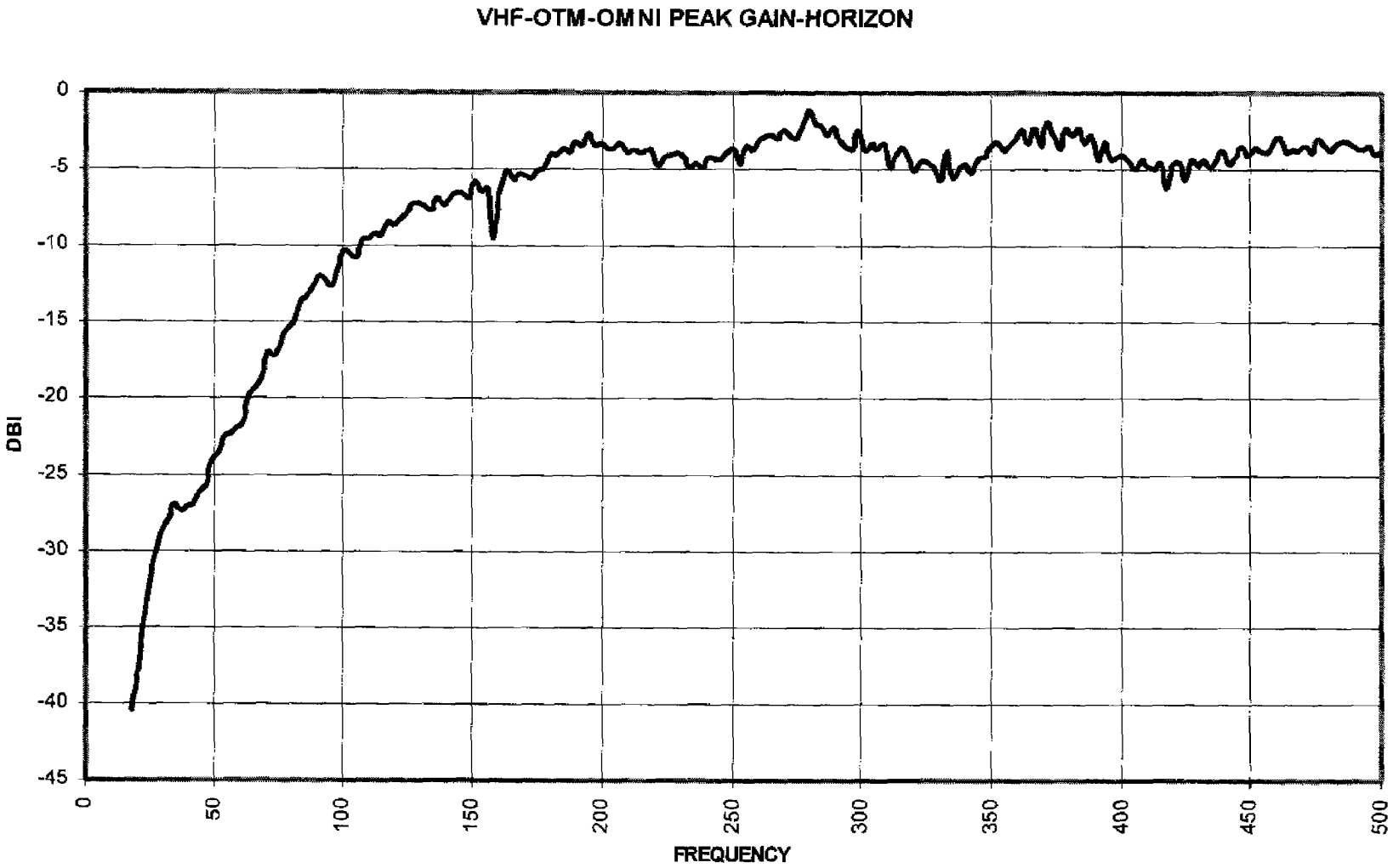
FIG. 27 illustrates OMNI pattern frequency gain data from an OTM antenna in accordance with an embodiment.
Figure 28:
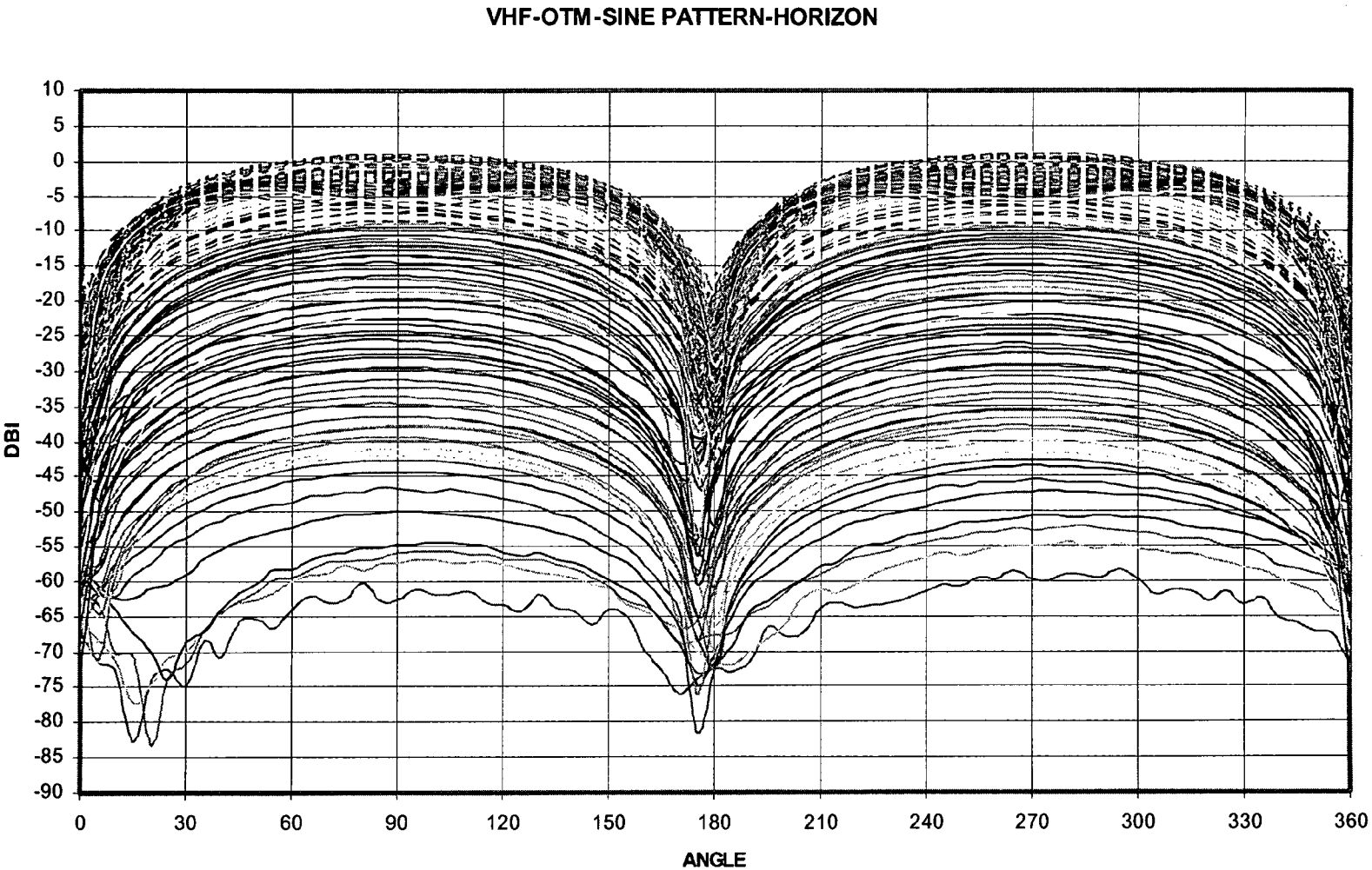
FIG. 28 illustrates SINE pattern angle data from an OTM antenna in accordance with an embodiment.
Figure 29:
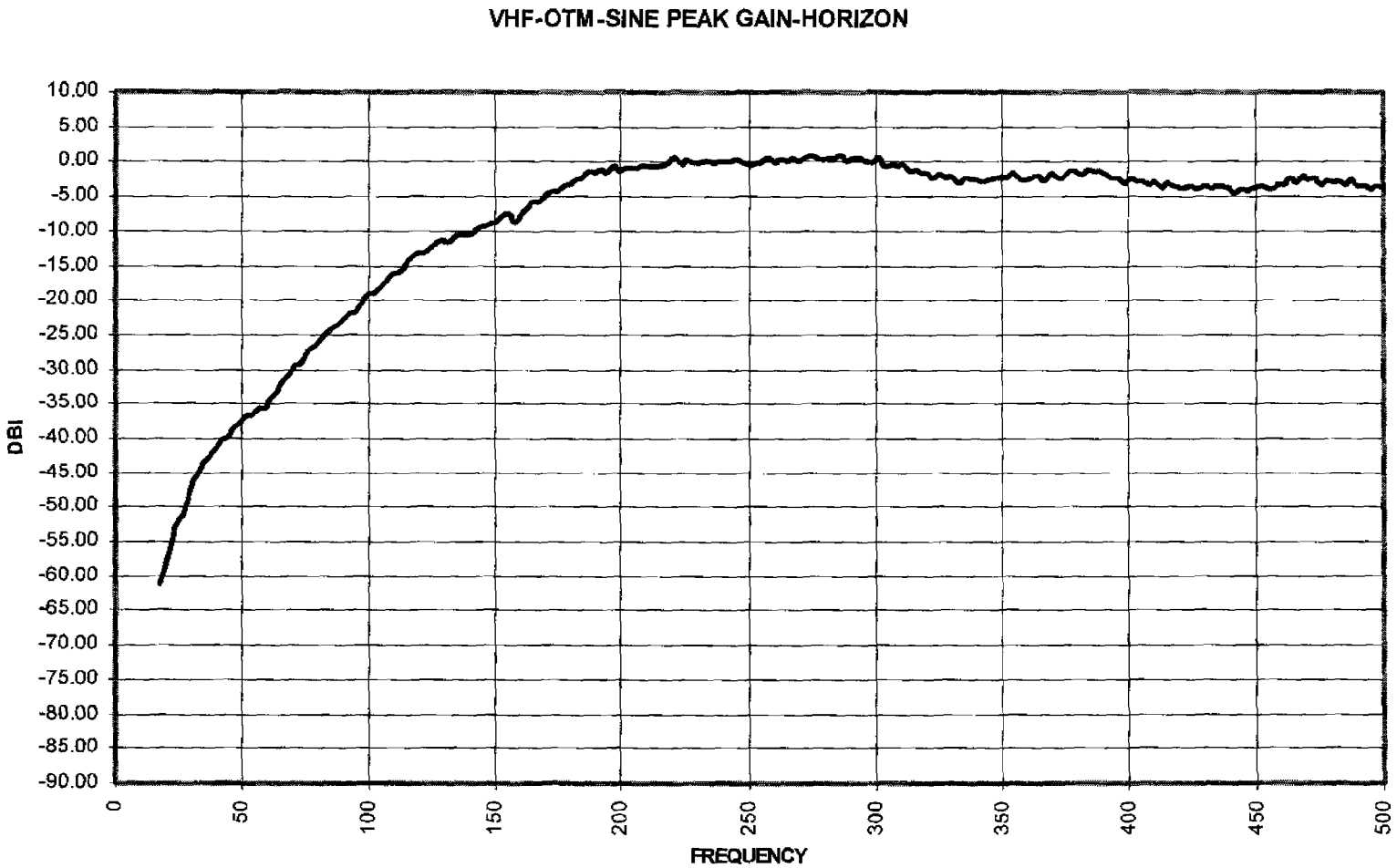
FIG. 29 illustrates SINE pattern frequency gain data from an OTM antenna in accordance with an embodiment.
Figure 30:
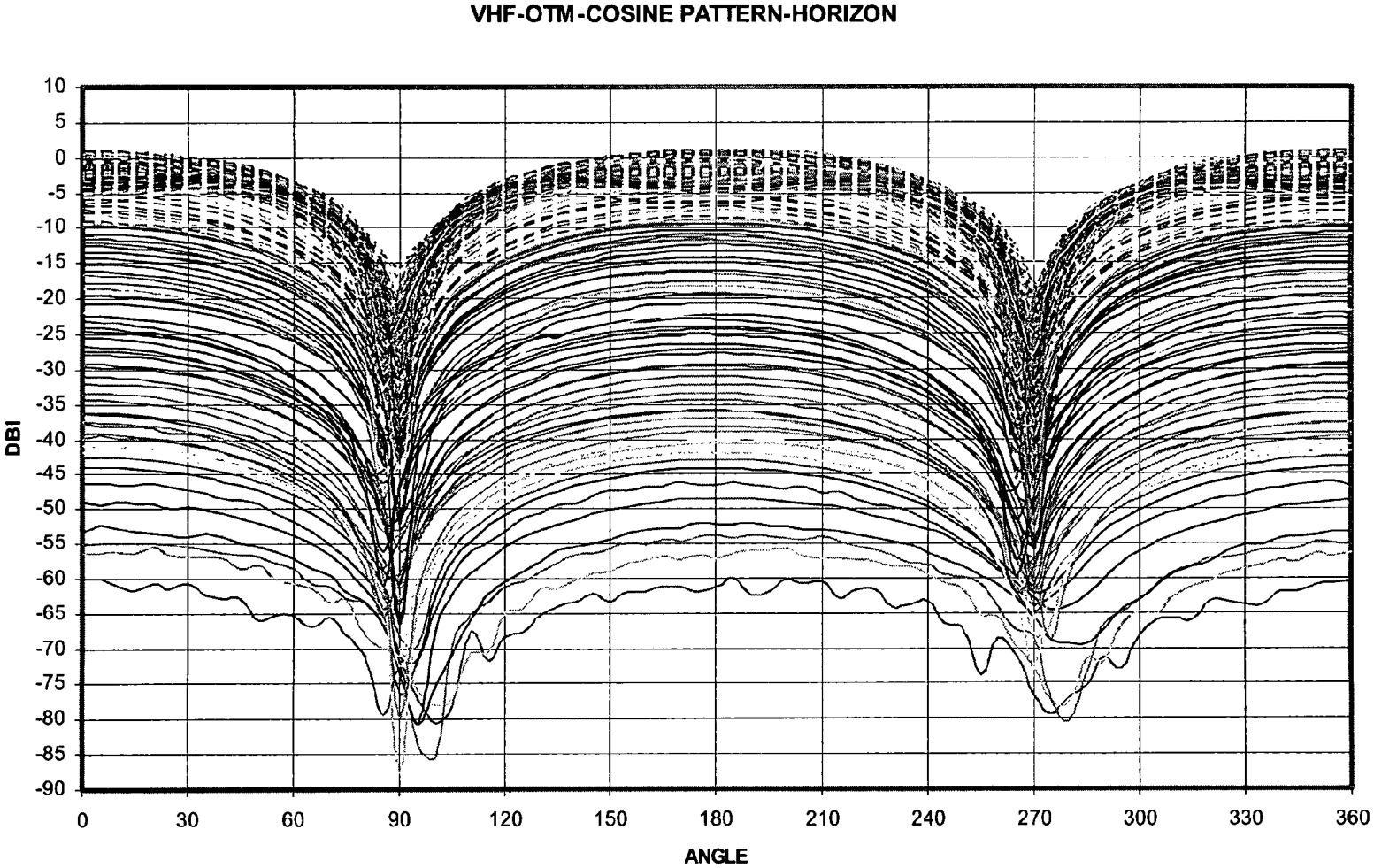
FIG. 30 illustrates COSINE pattern angle data from an OTM antenna in accordance with an embodiment.

FIG. 26 illustrates COSINE pattern frequency gain data from an OTM antenna such as OTM antenna 900 discussed above. FIG. 27 illustrates OMNI pattern frequency gain data from an OTM antenna such as OTM antenna 900 discussed above. FIG. 28 illustrates SINE pattern angle data from an OTM antenna such as OTM antenna 900 discussed above. FIG. 29 illustrates SINE pattern frequency gain data from an OTM antenna such as OTM antenna 900 discussed above. FIG. 30 illustrates COSINE pattern angle data from an OTM antenna such as OTM antenna 900 discussed above.

While several embodiments of the invention have been described, it will be understood that it is capable of further modifications, and this application is intended to cover any variations, uses, or adaptations of the invention, following in general the principles of the invention and including such departures from the present disclosure as to come within knowledge or customary practice in the art to which the invention pertains, and as may be applied to the essential features hereinbefore set forth and falling within the scope of the invention or the limits of the appended claims.

What is claimed is:

1. A direction-finding antenna with electronics for receiving radio signals in a frequency range of about 2 megaHertz to about 18 gigaHertz, said direction-finding antenna comprising:

an edge-radiating antenna comprising a first plate and a second plate disposed parallel to each other and radiating into open space, a concentric cylinder connecting the first plate to the second plate, eight feed points disposed equally around the outside of the concentric cylinder with eight feed lines extending from the first plate to the second plate, and a shunt resistor across each feed gap, wherein the eight feed lines are electrically coupled to a first beam forming matrix that finds a direction of a beam;

a monopole array comprising eight monopole elements connected to a first center mast, wherein the monopole array is disposed inside the concentric cylinder and resistively modified such that no resonance occurs, and wherein the eight monopole elements are electrically coupled to a second beam forming matrix that finds a direction of a beam;

a dipole array comprising eight dipole elements connected to a second center mast, wherein each of the eight dipole elements is resistively loaded to increase bandwidth, and wherein the eight dipole elements are electrically coupled to a third beam forming matrix that finds a direction of a beam; and a first and second biconical horn housing the edge-radiating antenna and dipole array, respectively, the first and second biconical horn each comprising eight ribs connecting a top horn to a bottom horn, wherein the eight ribs are electrically couple to a high impedance resistor disposed at the center of the biconical horn.

2. The direction finding antenna of claim 1, wherein the direction finding antenna is modular such that the edge-radiating antenna may be decoupled from the dipole array.

3. The direction finding antenna of claim 1, wherein the top horn and bottom horn of the first and second biconical horns each includes a base having an aperture termination including resistors in shunt with each other.

4. The direction finding antenna of claim 1, wherein the second center mast includes a plurality of resistors disposed on the mast to prevent resonance.

5. The direction finding antenna of claim 1, wherein the first, second and third beam forming matrices each comprise:
eight inputs;
a sine pattern output;
a cosine pattern output; and
an omni directional pattern output.

6. The direction finding antenna of claim 5, wherein the eight inputs include inputs A, B, C, D, E, F, G and H, and the sine pattern equals (input C+input D)−(input G+input H).

7. The direction finding antenna of claim 5, wherein the eight inputs include inputs A, B, C, D, E, F, G and H, and the cosine pattern equals (input A+input B)−(input E+input F).

8. The direction finding antenna of claim 5, wherein the omni directional pattern is the sum of the eight inputs.

9. The direction finding antenna of claim 5, wherein the sine, cosine, and omni directional patterns are used to calculate a direction of a beam.

10. A direction finding edge-radiating antenna comprising:
a first plate and a second plate disposed parallel to each other and radiating into open space;
a concentric cylinder connecting the first plate to the second plate;
eight feed points disposed equally around the outside of the concentric cylinder with eight feed lines extending from the first plate in the direction of the second plate, each feed point having a feed gap; and
at least one shunt resistor across each feed gap, wherein the eight feed lines are electrically coupled to a first beam forming matrix that finds a direction of a beam, and wherein the direction finding edge-radiating antenna operates in a first band.

11. The direction finding edge-radiating antenna of claim 10, in combination with:
a monopole array comprising eight monopole elements connected to a center mast, wherein the monopole array is resistively modified such that no resonance occurs, and wherein the eight monopole elements are electrically coupled to a second beam forming matrix that finds a direction of a beam;
wherein the monopole array and center mast project axially outside the concentric cylinder and operate in a second band different from the first band.

12. The direction finding edge-radiating antenna of claim 10, wherein the first and second beam forming matrices each comprise:
eight inputs;
a sine pattern output;
a cosine pattern output; and
an omni directional pattern output.

13. The direction finding edge-radiating antenna of claim 12, wherein the eight inputs include inputs A, B, C, D, E, F, G and H, and the sine pattern equals (input C+input D)−(input G+input H).

14. The direction finding edge-radiating antenna of claim 12, wherein the eight inputs include inputs A, B, C, D, E, F, G and H, and the cosine pattern equals (input A+input B)−(input E+input F).

15. The direction finding edge-radiating antenna of claim 12, wherein the omni directional pattern is the sum of the eight inputs.

16. The direction finding edge-radiating antenna of claim 12, wherein the sine, cosine, and omni directional patterns are used to calculate a direction of a beam.

17. The direction finding antenna of claim 12, wherein the sine, cosine, and omni directional patterns are used to calculate a direction of a beam.

18. A direction finding antenna, comprising:
a dipole array comprising eight dipole elements connected to a center mast, wherein each of the eight dipole elements is resistively loaded to increase bandwidth; and
a beam forming matrix that finds a direction of a beam electrically coupled to the dipole array, wherein:
the center mast includes a plurality of resistors disposed on the mast to prevent resonance.

19. The direction finding antenna of claim 18, wherein each dipole element is disposed one quarter wavelength away from the center mast at the highest operating frequency and one half wavelength apart on the circumference of the array.

20. The direction finding antenna of claim 18, wherein the beam forming matrix comprises:
eight inputs;
a sine pattern output;
a cosine pattern output; and
an omni directional pattern output.

21. The direction finding antenna of claim 20, wherein the eight inputs include inputs A, B, C, D, E, F, G and H, and the sine pattern equals (input C+input D)−(input G+input H).

22. The direction finding antenna of claim 20, wherein the eight inputs include inputs A, B, C, D, E, F, G and H, and the cosine pattern equals (input A+input B)−(input E+input F).

23. The direction finding antenna of claim 20, wherein the omni directional pattern is the sum of the eight inputs.

24. A biconical horn antenna, comprising:
an antenna;
a top horn;
a bottom horn;
eight ribs connecting the top horn to the bottom horn, wherein:
each of the eight ribs includes a feed point which connects to a beam forming matrix, and
each of the eight ribs is electrically coupled to an associated high impedance resistor belonging to a resistor array disposed at the center of the biconical horn antenna.

25. The biconical horn antenna of claim 24, wherein the top horn and bottom horn each includes a base having an aperture termination comprising resistors in shunt with each other.

26. The biconical horn antenna of claim 24, further comprising:
a first array of low frequency resistors attached to the top horn; and
a second array of low frequency resistors attached to the bottom horn.

27. The biconical horn antenna of claim 24, wherein the beam forming matrix comprises:
eight inputs;
a sine pattern output;
a cosine pattern output; and
an omni directional pattern output.

28. An On-the-Move antenna, comprising:
a base;
four dipole elements attached to the base, each dipole element including first ferrite beads and a first resistor between a feed point and the base;
a beam forming matrix electrically coupled to the four dipole elements, wherein the beam forming matrix determines a direction of a signal.

29. The On-the-Move antenna of claim 28, wherein each dipole element further comprises:
second ferrite beads located at the base, wherein the second ferrite beads are larger than the first ferrite beads.

30. The On-the-Move antenna of claim 28, further comprising:

a second resistor located near an end of each dipole element which is away from the base.

31. The On-the-Move antenna of claim 28, wherein the beam forming matrix comprises:

four inputs;

a sine pattern output;

a cosine pattern output; and an omni directional pattern output.

* * * * *